US008822115B2

(12) United States Patent
Yamano et al.

(10) Patent No.: US 8,822,115 B2
(45) Date of Patent: Sep. 2, 2014

(54) ELECTROPHOTOGRAPHIC PHOTORECEPTOR, PROCESS CARTRIDGE, IMAGE FORMING APPARATUS, AND IMAGE FORMING METHOD

(71) Applicant: Fuji Xerox Co., Ltd., Tokyo (JP)

(72) Inventors: Yuko Yamano, Kanagawa (JP); Daisuke Haruyama, Minamiashigara (JP); Shinya Yamamoto, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 21 days.

(21) Appl. No.: 13/626,437

(22) Filed: Sep. 25, 2012

(65) Prior Publication Data

US 2013/0244148 A1 Sep. 19, 2013

(30) Foreign Application Priority Data

Mar. 16, 2012 (JP) ..... 2012-061119

(51) Int. Cl.

| | |
|---|---|
| ***G03G 5/00*** | (2006.01) |
| ***G03G 5/05*** | (2006.01) |
| ***G03G 5/147*** | (2006.01) |
| ***G03G 5/07*** | (2006.01) |
| ***G03G 21/18*** | (2006.01) |
| ***G03G 5/06*** | (2006.01) |
| ***G03G 15/00*** | (2006.01) |

(52) U.S. Cl.

CPC ..... *G03G 5/06* (2013.01); *G03G 5/0514* (2013.01); *G03G 5/0592* (2013.01); *G03G 5/0567* (2013.01); *G03G 2215/00957* (2013.01); *G03G 5/1476* (2013.01); *G03G 5/076* (2013.01); *G03G 21/18* (2013.01); *G03G 5/14791* (2013.01); *G03G 5/14786* (2013.01); *G03G 5/0596* (2013.01); *G03G 5/14795* (2013.01); *G03G 15/00* (2013.01)

USPC ..... 430/66; 430/58.05; 430/58.35; 399/159

(58) Field of Classification Search

USPC ..... 430/66, 58.05, 58.35; 399/159

See application file for complete search history.

(56) References Cited

U.S. PATENT DOCUMENTS

2009/0238602 A1 9/2009 Iwasaki et al.

FOREIGN PATENT DOCUMENTS

| | | |
|---|---|---|
| JP | A-2009-229549 | 10/2009 |
| JP | A-2010-210814 | 9/2010 |

*Primary Examiner* — Mark A Chapman

(74) *Attorney, Agent, or Firm* — Oliff PLC

(57) ABSTRACT

An electrophotographic photoreceptor includes a conductive substrate, a photosensitive layer, and a surface layer that is provided on the photosensitive layer. The surface layer includes a cross-linked component which is a reaction product of compound A and compound B. The compound A is at least one compound selected from guanamine compounds and melamine compounds, and the compound B is a charge-transporting material. A structure derived from at least one compound selected from the guanamine compounds and the melamine compounds included in the surface layer amounts for 0.1% by weight to 5% by weight, and a structure derived from the charge-transporting material included in the surface layer amounts for 85% by weight or greater. Surface roughness Rz of the surface layer is from 0.1 μm to 0.3 μm, and the surface has at least one compound selected from fatty acid metal salt and fluorine resin particles.

17 Claims, 5 Drawing Sheets

ELECTROPHOTOGRAPHIC PHOTORECEPTOR, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-061119 filed Mar. 16, 2012.

BACKGROUND

Technical Field

The present invention relates to an electrophotographic photoreceptor, a process cartridge, an image forming apparatus, and an image forming method.

SUMMARY

According to an aspect of the invention, there is provided an electrophotographic photoreceptor including a conductive substrate; a photosensitive layer; and a surface layer that is provided on the photosensitive layer or is contained in the photosensitive layer, wherein, the surface layer includes a cross-linked component which is a reaction product of compound A and compound B, wherein the compound A is at least one compound selected from guanamine compounds and melamine compounds, and the compound B is a charge-transporting material having at least one substituent selected from —OH, —$OCH_3$, —$NH_2$, —SH, and —COOH, a structure derived from at least one compound selected from the guanamine compounds and the melamine compounds included in the surface layer amounts for 0.1% by weight to 5% by weight, and a structure derived from the charge-transporting material included in the surface layer amounts for 85% by weight or greater, surface roughness Rz of the surface layer is from 0.1 μm to 0.3 μm, and the surface has at least one compound selected from fatty acid metal salt and fluorine resin particles, and the electrophotographic photoreceptor satisfies the relationships represented by the following Expressions (1) and (2):

$$Y \leq -5X+150 \quad \text{Expression (1)}$$

$$Y \geq -0.75X+30 \quad \text{Expression (2)}$$

wherein Y represents a coverage of the fatty acid metal salt, and X represents a coverage of the fluorine resin particles.

BRIEF DESCRIPTION OF THE DRAWINGS

Exemplary embodiments of the present invention will be described in detail based on the following figures, wherein.

DETAILED DESCRIPTION

Figure 1:
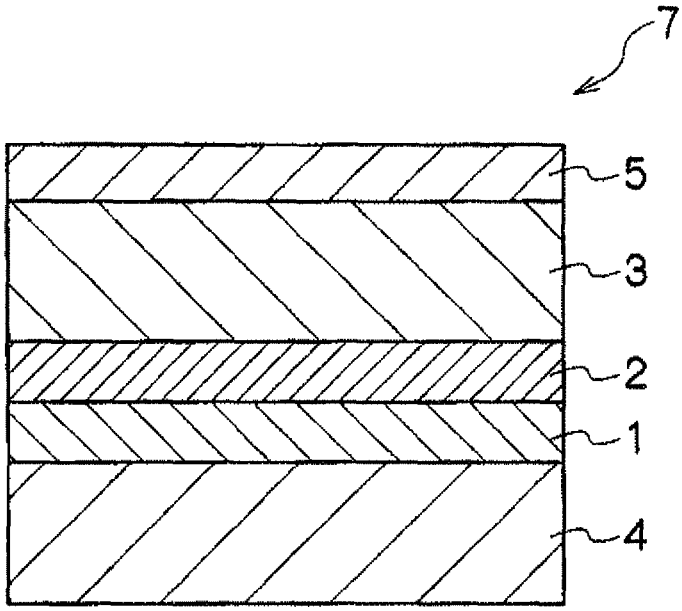
FIG. 1 is a schematic cross-sectional view showing a suitable example of a photoreceptor of an exemplary embodiment.

Hereinafter, exemplary embodiments of an electrophotographic photoreceptor, a process cartridge, an image forming apparatus, and an image forming method of the invention will be described in detail.

Electrophotographic Photoreceptor

An electrophotographic photoreceptor of an exemplary embodiment (hereinafter, sometimes referred to as the photoreceptor of this exemplary embodiment) has a conductive substrate and a photosensitive layer provided on the conductive substrate. A surface layer positioned on the surface where the photosensitive layer is provided includes a cross-linked component which is a reaction product of compound A and compound B, wherein the compound A is at least one compound selected from guanamine compounds and melamine compounds, and the compound B is a charge-transporting material having at least one substituent selected from —OH, —$OCH_3$, —$NH_2$, —SH, and —COOH. A structure derived from at least one compound selected from the guanamine compounds and the melamine compounds included in the surface layer amounts for 0.1% by weight to 5% by weight, and a structure derived from the charge-transporting material included in the surface layer amounts for 85% by weight or greater. A coverage Y (%) of fatty acid metal salt and a coverage X (%) of fluorine resin particles on the surface of the surface layer satisfy the relationships represented by the following Expressions (1) and (2), and surface roughness Rz of the surface of the surface layer is from 0.1 μm to 0.3 μm.

The photoreceptor of this exemplary embodiment has excellent mechanical durability, and may form a stabilized image.

$$Y \leq -5X+150 \quad \text{Expression (1)}$$

$$Y \geq -0.75X+30 \quad \text{Expression (2)}$$

As for the photoreceptor of this exemplary embodiment, the photoreceptor more preferably satisfies the relationship represented by the following Expression (3).

$$Y > 5X-100 \quad \text{Expression (3)}$$

In the photoreceptor of this exemplary embodiment, although the coverage Y (%) of the fatty acid metal salt and the coverage X (%) of the fluorine resin particles on the surface of the surface layer satisfy the relationships represented by Expressions (1) and (2), at least one of the fatty acid metal salt and the fluorine resin particles may be used as a component of the surface layer and the component may be incorporated in the surface layer to satisfy the relationships, or at least one of the fatty acid metal salt and the fluorine resin particles may be adhered to the surface of the surface layer to satisfy the relationships. Furthermore, at least one of the fatty acid metal salt and the fluorine resin particles may be used as a component of the surface layer and the component may be incorporated into the surface layer, and at least one of the fatty acid metal salt and the fluorine resin particles may be adhered to the surface of the surface layer to satisfy the relationships.

In this exemplary embodiment, the coverage Y (%) of the fatty acid metal salt and the coverage X (%) of the fluorine resin particles on the surface of the surface layer are measured using an X-ray photoelectron spectroscopy system (XPS). The detailed measurement method thereof is as follows.

The coverage that is obtained using X-ray photoelectron spectroscopy analysis is measured using JPS 9010 (manufactured by JEOL Ltd.). For example, when calculating the coverage of zinc stearate, it is determined on the basis of the value of a ratio of zinc to all of the elements. The XPS analysis is analysis of the top surface of the photoreceptor. Accordingly, when the amount of zinc stearate on the surface of the photoreceptor increases, the value of the ratio of zinc to all of the elements is saturated. The saturated value of the ratio of zinc to all of the elements is set as 100% of coverage, and the coverage of zinc on the surface of the photoreceptor is determined. Similarly, coverage of other fatty acid metal salts and fluorine resin particles is calculated by focusing on characteristic metal elements and a fluorine element. The values mentioned in this specification are measured using the above method.

The upper limits of the coverage Y (%) of the fatty acid metal salt and the coverage X (%) of the fluorine resin particles are 100%, and the lower limits thereof are 0%.

When adhering one of the fatty acid metal salt and the fluorine resin particles to the surface of the surface layer, the coverage Y (%) of the fatty acid metal salt and the coverage X (%) of the fluorine resin particles on the surface of the photoreceptor are measured after a supply unit supplies at least one of the fatty acid metal salt and the fluorine resin particles to the surface of the surface layer and before a toner removing unit (cleaning blade) which removes a toner remaining on the surface of the photoreceptor cleans the surface of the photoreceptor.

In this exemplary embodiment, the surface roughness (ten-point average roughness) Rz of the surface of the surface layer is measured using SURFCOM (manufactured by Tokyo Seimitsu Co., Ltd.) on the basis of JIS B0601 (1994).

The surface roughness Rz of the surface of the surface layer is from 0.1 μm to 0.3 μm in this embodiment, and preferably from 0.1 μm to 0.15 μm.

When the surface roughness Rz is less than 0.1 μm, a problem may occur in that image quality defects are caused together with blade oscillation due to severe friction between the photoreceptor and the blade. On the other hand, when the surface roughness Rz is greater than 0.3 μm, a problem may occur in that image quality defects are caused together with slipping-through of the toner or lubricant.

Hereinafter, the photoreceptor of this exemplary embodiment will be described in detail with reference to the drawings. In the drawings, the same or corresponding parts will be denoted by the same reference numerals, and overlapping descriptions will be omitted.

Figure 2:
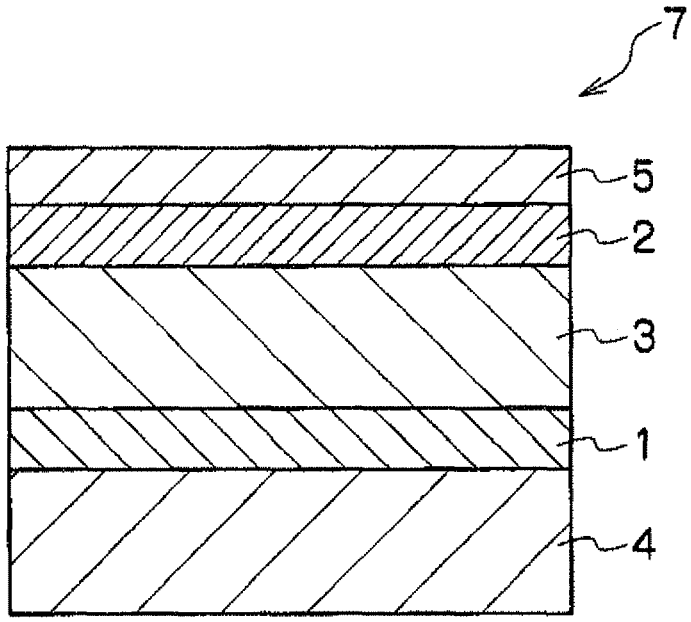
FIG. 2 is a schematic cross-sectional view showing another suitable example of the photoreceptor of the exemplary embodiment.
Figure 3:
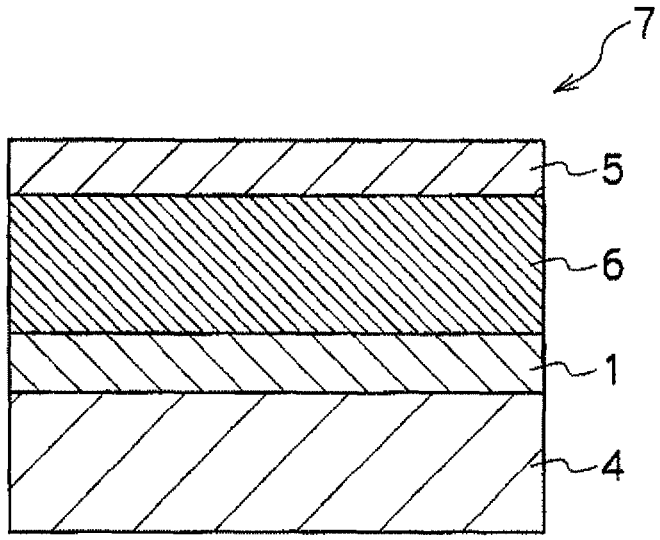
FIG. 3 is a schematic cross-sectional view showing further another suitable example of the photoreceptor of the exemplary embodiment.

FIG. 1 is a schematic cross-sectional view showing a suitable example of the photoreceptor of this exemplary embodiment. FIGS. 2 and 3 are schematic cross-sectional views showing other suitable examples of the photoreceptor of this exemplary embodiment, respectively.

An electrophotographic photoreceptor 7 shown in FIG. 1 is a so-called functional separation-type photoreceptor (or laminated photoreceptor), and has a structure in which an undercoat layer 1 is provided on a conductive substrate 4, and a charge generation layer 2, a charge transport layer 3, and a protective layer 5 are formed sequentially thereon. In the electrophotographic photoreceptor 7, the charge generation layer 2 and the charge transport layer 3 form a photosensitive layer.

An electrophotographic photoreceptor 7 shown in FIG. 2 is a functional separation-type photoreceptor with functions separated into a charge generation layer 2 and a charge transport layer 3 as in the case of the electrophotographic photoreceptor 7 shown in FIG. 1. In addition, an electrophotographic photoreceptor 7 shown in FIG. 3 is a photoreceptor in which a charge generation material and a charge transport material are contained in the same layer (single layer-type photoreceptor 6 (charge generation/charge transport layer)).

The electrophotographic photoreceptor 7 shown in FIG. 2 has a structure in which an undercoat layer 1 is provided on a conductive substrate 4, and the charge transport layer 3, the charge generation layer 2, and a protective layer 5 are formed sequentially thereon. In the electrophotographic photoreceptor 7 shown in FIG. 2, the charge transport layer 3 and the charge generation layer 2 form a photosensitive layer.

In addition, the electrophotographic photoreceptor 7 shown in FIG. 3 has a structure in which an undercoat layer 1 is provided on a conductive substrate 4, and a single layer-type photosensitive layer 6 and a protective layer 5 are formed sequentially thereon.

In the electrophotographic photoreceptors 7 shown in FIGS. 1 to 3, the protective layer 5 is a surface layer positioned on the surface where the photosensitive layer is provided, and includes a cross-linked component which is a reaction product of at least one compound selected from guanamine compounds and melamine compounds and a charge-transporting material (hereinafter, sometimes referred to as the specific charge-transporting material) having at least one substituent selected from —OH, —$OCH_3$, —$NH_2$, —SH, and —COOH. In addition, a structure derived from at least one compound selected from the guanamine compounds and the melamine compounds amounts for 0.1% by weight to 5% by weight of the surface layer, and a structure derived from the specific charge-transporting material amounts for 85% by weight or greater of the surface layer. The structure derived from the specific charge-transporting material preferably amounts for 96% by weight or greater of the surface layer. In addition, the structure derived from the specific charge-transporting material preferably amounts for 99% by weight or less of the surface layer.

In the electrophotographic photoreceptors shown in FIGS. 1 to 3, the undercoat layer 1 may not be provided.

Hereinafter, the respective elements will be described on the basis of the electrophotographic photoreceptor 7 shown in FIG. 1 as a representative example.

Conductive Substrate

The conductive substrate 4 is, for example, a metallic plate, a metallic drum, or a metallic belt formed of a metal such as aluminum, copper, zinc, stainless steel, chromium, nickel, molybdenum, vanadium, indium, gold, or platinum or an alloy thereof, or paper, a plastic film, or a belt including a conductive polymer, a conductive compound such as indium oxide, metal such as aluminum, palladium, or gold or an alloy thereof applied thereto or deposited or laminated thereon. Here, "conductive" means that volume resistivity is less than $10^{13}$ Ω·cm.

When the electrophotographic photoreceptor 7 is used in a laser printer, the surface of the conductive substrate 4 is preferably roughened to have centerline average roughness Ra of from 0.04 μm to 0.5 μm in order to prevent interference fringes that are formed when irradiated by laser light. When Ra is less than 0.04 μm, the surface is almost a mirror surface, and thus there is a tendency that a satisfactory effect of interference prevention may not be exhibited. When Ra is greater than 0.5 μm, there is a tendency that the image quality may be degraded even when a film is formed. Using an incoherent light source is suitable for increasing the lifetime because surface roughening for preventing interference fringes is not particularly necessary, and occurrence of defects due to the irregularities on the surface of the conductive substrate 4 is prevented.

Undercoat Layer

The undercoat layer 1 includes, for example, a binder resin containing inorganic particles.

As the inorganic particles, inorganic particles having powder resistance (volume resistivity) of from $10^2$ Ω·cm to $10^{11}$ Ω·cm are preferably used. This is because the undercoat layer 1 is required to obtain adequate resistance in order to achieve leak resistance and a carrier blocking property. When the resistance value of the inorganic particles is lower than the lower limit of the above range, sufficient leak resistance may not be obtained, and when the resistance value of the inorganic particles is higher than the upper limit of the above range, the residual potential may be increased.

Preferable examples of the inorganic particles having the above resistance value include inorganic particles of tin oxide, titanium oxide, zinc oxide, and zirconium oxide (conductive metal oxides), and zinc oxide is particularly preferably used.

In addition, the inorganic particles may be surface-treated. In addition, inorganic particles subjected to different surface treatments, or a mixture of two or more types having different particle diameters may be used. The volume average particle diameter of the inorganic particles is preferably from 50 nm to 2000 nm (more preferably from 60 nm to 1000 nm).

In addition, inorganic particles having a specific surface area (measured using a BET method) of 10 $m^2/g$ or greater are preferably used. When the specific surface area is less than 10 $m^2/g$, there is a tendency that the charging property may be easily reduced and favorable electrophotographic characteristics may not be easily obtained.

Furthermore, by incorporating inorganic particles and an acceptor compound, an undercoat layer that is excellent in carrier blocking property and long-term stability of electrical characteristics is obtained. As the acceptor compound, any material may be used as long as desired characteristics are obtained, and preferable examples thereof include electron-transporting substances such as quinone compounds such as chioranil and bromanil, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole, xanthone compounds, thiophene compounds, and diphenoquinone compounds such as 3,3',5,5'-tetra-t-butyldiphenoquinone, and compounds having an anthraquinone structure are particularly preferable. Furthermore, acceptor compounds having an anthraquinone structure such as hydroxyanthraquinone compounds, aminoanthraquinone compounds, and aminohydroxyanthraquinone compounds are preferably used, and specific examples thereof include anthraquinone, alizarin, quinizarin, anthrarufin, and purpurin.

Although the content of the acceptor compound may be set so that desired characteristics are obtained, the content is preferably from 0.01% by weight to 20% by weight with respect to the inorganic particles, and more preferably from 0.05% by weight to 10% by weight from the viewpoint of preventing accumulation of charges and aggregation of the inorganic particles. The aggregation of the inorganic particles easily causes a variation in forming conductive channels, a deterioration in maintainability such as an increase in residual potential in repeated use, and image quality defects such as black dots.

The acceptor compound may simply be added when forming the undercoat layer, or may be adhered to the surfaces of the inorganic particles in advance. The acceptor compound is applied to the surfaces of the inorganic particles by a dry method or a wet method.

When the surface treatment is performed using a dry method, an acceptor compound as is or dissolved in an organic solvent is added dropwise and sprayed together with dry air or nitrogen gas while inorganic particles are stirred using a mixer or the like having a large shear force, whereby the particles are treated without causing a variation. The addition or spraying is preferably performed at a temperature lower than the boiling point of the solvent. It is not preferable that the spraying be performed at a temperature equal to higher than the boiling point of the solvent, because there is a disadvantage in that the solvent evaporates before stirring of the inorganic particles without causing a variation and the acceptor compound hardens locally so that the treatment without causing a variation is difficult to conduct. After the addition or spraying, the inorganic particles may further be subjected to baking at a temperature of 100° C. or higher. The baking is performed at an arbitrary temperature for an arbitrary time as long as desired electrophotographic characteristics are obtained.

In a wet method, inorganic particles are dispersed in a solvent by means of stirring, ultrasonic waves, a sand mill, an attritor, a ball mill or the like, and then an acceptor compound is added thereto and the resultant mixture is further stirred or dispersed. Thereafter, the solvent is removed, whereby the particles are surface-treated without causing a variation. Examples of the solvent removing method include filtration and distillation. After removing the solvent, the particles may be subjected to baking at a temperature of 100° C. or higher. The baking is performed at an arbitrary temperature for an arbitrary time as long as desired electrophotographic characteristics are obtained. In the wet method, the moisture contained in the inorganic particles may be removed prior to the addition of the surface treatment agent. The moisture may be removed by, for example, stirring and heating the particles in the solvent used in the surface treatment, or by azeotropy with the solvent.

In addition, the inorganic particles may be surface-treated prior to the addition of the acceptor compound. Any material may be used as the surface treatment agent as long as desired characteristics are obtained, and it is selected from known materials. Examples thereof include silane coupling agents, titanate coupling agents, aluminum coupling agents, and surfactants. Particularly, silane coupling agents are preferably used, because favorable electrophotographic characteristics are provided. Furthermore, silane coupling agents having an amino group are preferably used, because a favorable blocking property is provided to the undercoat layer 1.

As the silane coupling agent having an amino group, any material may be used as long as desired electrophotographic photoreceptor characteristics are obtained. Specific examples thereof include, but are not limited to, γ-aminopropyltriethoxysilane, N-β-(aminoethyl)-γ-aminopropyltrimethoxysilane, N-β-(aminoethyl)-γ-aminopropylmethyldilmethoxysilane, and N,N-bis(β-hydroxyethyl)-γ-aminopropyltriethoxysilane.

In addition, the silane coupling agents may be used singly or in mixture of two or more types. Examples of the silane coupling agents that may be used in combination with the above-described silane coupling agents having an amino group include, but are not limited to, vinyltrimethoxysilane, γ-methacryloxypropyl-tris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-

(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Although any known method may be used as the surface treatment method, a dry method or a wet method may be used. In addition, addition of an acceptor and a surface treatment using a coupling agent or the like may be performed at the same time.

Although the content of the silane coupling agent with respect to the inorganic particles in the undercoat layer 1 may be set so that desired electrophotographic characteristics are obtained, the content is preferably from 0.5% by weight to 10% by weight with respect to the inorganic particles from the viewpoint of improving dispersibility.

Any known material may be used as the binder resin contained in the undercoat layer 1, as long as a favorable film is formed and desired characteristics are obtained. Examples thereof include known polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resin; charge-transporting resins having a charge-transporting group; and conductive resins such as polyaniline. Among them, resins insoluble in the coating solvent of the upper layer are preferably used, and phenol resins, phenol-formaldehyde resins, melamine resins, urethane resins, and epoxy resins, and the like are particularly preferably used. When these are used in combination of two or more types, the mixing ratio thereof is set in accordance with the need.

The ratio between the metal oxide to which an acceptor property has been imparted and the binder resin, or the ratio between the inorganic particles and the binder resin in a coating liquid for undercoat layer formation may be set so that desired electrophotographic photoreceptor characteristics are obtained.

Various additives may be used in the undercoat layer 1 to improve electrical characteristics, environmental stability, and image quality. Examples of the additives include known materials such as electron-transporting pigments, e.g., polycyclic condensed electron-transporting pigments and azo electron-transporting pigments, zirconium chelate compounds, titanium chelate compounds, aluminum chelate compounds, titanium alkoxide compounds, organic titanium compounds, and silane coupling agents. Although a silane coupling agent is used in a surface treatment of the metallic oxide, it may also be added as an additive to the coating liquid. Specific examples of the silane coupling agent used herein include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compounds include aluminum isopropylate, monobutoxy aluminum diisopropylate, aluminum butylate, ethyl acetoacetate aluminum diisopropylate, and aluminum tris(ethyl acetoacetate).

These compounds may be used singly or as a mixture or a polycondensate of plural compounds.

The solvent for preparing the coating liquid for undercoat layer formation is selected from known organic solvents, such as alcohol, aromatic, halogenated hydrocarbon, ketone, ketone alcohol, ether, and ester organic solvents. Examples of the solvent include usual organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents for use in dispersion may be used singly or in mixture of two or more types. In the mixing, any material may be used as long as it may dissolve a binder resin as a mixed solvent.

As a dispersion method, a known method using a roll mill, a ball mill, a vibrating ball mill, an attritor, a sand mill, a colloid mill, or a paint shaker is used. Furthermore, as a coating method that is used when the undercoat layer 1 is provided, a common method such as a blade coating method, a wire bar coating method, a spray coating method, a dipping coating method, a bead coating method, an air knife coating method, or a curtain coating method is used.

Using the coating liquid for undercoat layer formation obtained in this manner, the undercoat layer 1 is formed on the conductive substrate.

In addition, the Vickers' hardness of the undercoat layer 1 is preferably 35 or greater.

Furthermore, although the undercoat layer 1 may have any thickness as long as desired characteristics are obtained, the thickness thereof is preferably 15 μm or greater, and more preferably from 15 μm to 50 μm.

When the thickness of the undercoat layer 1 is less than 15 μm, a sufficient leakage resistance performance may not be obtained. When the thickness of the undercoat layer 1 is greater than 50 μm, there is a disadvantage in that the residual potential easily remains during the long-term use and defects are easily caused in image density.

In addition, in order to prevent a moire fringe, the surface roughness (ten-point average roughness) of the undercoat layer 1 is adjusted to from ¼n of a wavelength λ of an exposure laser to be used (n is a refractive index of the upper layer) to ½λ. Particles such as resin particles may be added to the undercoat layer to adjust the surface roughness. Examples of the resin particles include silicone resin particles and cross-linked polymethyl methacrylate resin particles.

Here, the undercoat layer contains a binder resin and a conductive metal oxide, and when having a thickness of 20 μm, the undercoat layer has a light transmittance of 40% or less, preferably 10% to 35%, and more preferably 15% to 30% with respect to light having a wavelength of 950 nm. In an electrophotographic photoreceptor having an increased lifetime, it is necessary to maintain stable high image quality. When a cross-linked outermost surface layer (protective layer) is used, the same characteristics are also required. When a cross-linked outermost surface layer (protective layer) is used, an acid catalyst is used for curing in many cases, and the higher the amount of the acid catalyst with respect to the solid content in the outermost surface layer (protective layer), the higher the film strength, whereby print durability is increased and a long lifetime may thus be achieved. On the other hand, since the residual catalyst in the bulk acts as a trap site of charges, the resistance to light-induced fatigue is reduced, and unevenness occurs in image density due to light exposure during maintenance or the like. Although the light resistance (resistance to light-induced fatigue) may be improved to an available level for practical use by optimizing the amounts of materials (particularly, charge transport material and acid catalyst), this may not be sufficient for an environment brighter than general offices, such as a showroom irradiated with brighter light, or high-intensity exposure for a long period of time at the time when foreign substances adhered to the surface of an electrophotographic photoreceptor are observed. Accordingly, in order to achieve a long lifetime, it is necessary to increase the amount of the curing catalyst to thereby increase a film strength. However, in that case, the light resistance may be insufficient. Accordingly, when an undercoat layer having the predetermined light transmittance (that is, a low light transmittance) is used, the light incident on the electrophotographic photoreceptor is absorbed by the undercoat layer, whereby an image excellent in light resistance with respect to high-intensity light is stably obtained over a long period of time. That is, since the light reflected from the surface of the conductive substrate is reduced, even when the light resistance (resistance to light-induced fatigue) to the high-intensity light exposure for a long period of time is attained, and for example, the amount of the curing catalyst is increased and the strength of the outermost surface layer (protective layer) is increased to improve the print durability, a long lifetime is realized.

The light transmittance of the undercoat layer is measured as follows. A coating liquid for undercoat layer formation is applied to a glass plate so that a thickness after drying is 20 μm, and after drying, the light transmittance of the film is measured at a wavelength of 950 nm using a spectrophotometer. The light transmittance is measured using a spectrophotometer "Spectrophotometer (U-2000)" (device name) (manufactured by Hitachi, Ltd.).

The light transmittance of the undercoat layer may be controlled by adjusting a dispersion time at the time of dispersion using a roll mill, a ball mill, a vibrating ball mill, an attritor, a sand mill, a colloid mill, a paint shaker or the like as described above. Although the dispersion time is not particularly limited, an arbitrary time of five minutes to 1,000 hours is preferable, and 30 minutes to 10 hours is more preferable. The light transmittance tends to be reduced when the dispersion time is increased.

In addition, the undercoat layer may be abraded to adjust the surface roughness thereof. Buffing, a sandblast treatment, wet honing, a grinding treatment, and the like are used as an abrasion method.

The undercoat layer is obtained by drying the applied coating, which is usually carried out at a temperature at which the solvent is evaporated and a film may be formed.

Charge Generation Layer

The charge generation layer 2 contains a charge generation material and a binder resin.

Examples of the charge generation material include azo pigments such as bisazo and trisazo pigments, condensed aromatic pigments such as dibromoantanthrone, perylene pigments, pyrrolopyrrole pigments, phthalocyanine pigments, zinc oxide, and trigonal selenium. Among them, metal phthalocyanine pigments and metal-free phthalocyanine pigments are preferable for exposure with a near-infrared region laser, and particularly, hydroxygalliumphthalocyanine, chlorogallium phthalocyanine, dichlorotin phthalocyanine, and titanyl phthalocyanine are more preferable. In addition, for exposure with a near-ultraviolet region laser, condensed aromatic pigments such as dibromoantanthrone, thioindigo pigments, porphyrazine compounds, zinc oxide, trigonal selenium, and the like are more preferable. When a light source having an exposure wavelength of 380 nm to 500 nm is used, inorganic pigments are preferable as the charge generation material, and when a light source having an exposure wavelength of 700 nm to 800 nm is used, metal phthalocyanine pigments and metal-free phthalocyanine pigments are preferable as the charge generation material.

A hydroxygallium phthalocyanine pigment having a maximum peak wavelength within a range of from 810 nm to 839 nm in a spectral absorption spectrum in a wavelength region of 600 nm to 900 nm is preferably used as the charge generation material. The hydroxygallium phthalocyanine pigment is different from a conventional. V-type hydroxygallium phthalocyanine pigment, and is preferable because more excellent dispersibility is obtained. In this manner, by shifting the maximum peak wavelength of the spectral absorption spectrum to a shorter wavelength side than in the case of the conventional V-type hydroxygallium phthalocyanine pigment, fine hydroxygallium phthalocyanine pigment particles with a preferably controlled crystal arrangement of the pigment particles are obtained, and when this hydroxygallium phthalocyanine pigment is used as a material for the electrophotographic photoreceptor, excellent dispersibility, sufficient sensitivity, a sufficient charging property and sufficient dark decay characteristics are obtained.

In addition, it is preferable that the hydroxygallium phthalocyanine pigment having a maximum peak wavelength within the range of from 810 nm to 839 nm has an average particle diameter in a specific range and have a BET specific surface area in a specific range. Specifically, the average particle diameter is preferably 0.2 μm or less, and more preferably from 0.01 μm to 0.15 μm, and the BET specific surface area is preferably 45 $m^2/g$ or greater, more preferably 50 $m^2/g$ or greater, and particularly preferably from 55 $m^2/g$ to 120 $m^2/g$. The average particle diameter is a volume average particle diameter (d50 average particle diameter) measured by a laser diffraction scattering-type particle size distribution measuring apparatus (LA-700, manufactured by Horiba, Ltd.), and the BET specific surface area is a value measured using a BET-type specific surface area measuring unit (manufactured by Shimadzu Corporation: FlowSorb II2300) with a nitrogen substitution method.

When the average particle diameter is greater than 0.20 μm, or the specific surface area is less than 45 $m^2/g$, the pigment particles coarsen, or aggregates of the pigment particles are formed, so that when such a pigment is used as a material for the electrophotographic photoreceptor, there is a tendency that characteristics such as dispersibility, sensitivity, a charging property, and dark decay characteristics may deteriorate, and thus there is a tendency that image quality defects may be easily caused.

In addition, the maximum particle diameter (maximum value of primary particle diameter) of the hydroxygallium phthalocyanine pigment is preferably 1.2 μm or less, more preferably 1.0 μm or less, and even more preferably 0.3 μm or less. When the maximum particle diameter exceeds the above range, micro black dots tend to occur.

Furthermore, from the viewpoint of more securely preventing unevenness in density resulting from the exposure of the photoreceptor to fluorescent light, it is preferable that the hydroxygallium phthalocyanine pigment has an average particle diameter of 0.2 μm or less, a maximum particle diameter of 1.2 μm or less, and a specific surface area of 45 $m^2/g$ or greater.

In addition, the hydroxygallium phthalocyanine pigment preferably has diffraction peaks at Bragg angles (2θ±0.2°) of 7.5°, 9.9°, 12.5°, 16.3°, 18.6°, 25.1° and 28.3° in the X-ray diffraction spectrum using CuKα characteristic X-ray.

The binder resin for use in the charge generation layer 2 is selected from a wide range of insulating resins, and may be selected from organic photoconductive polymers such as poly-N-vinyl carbazole, polyvinyl anthracene, polyvinyl pyrene, and polysilane. Preferable examples of the binder resin include polyvinyl butyral resins, polyarylate resins (polycondensates of bisphenols and aromatic divalent carboxylic acids and the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binder resins may be used singly or in mixture of two or more types. The blending ratio of the charge generation material to the binder resin is preferably 10:1 to 1:10 in terms of weight ratio. Here, "insulating" means that the volume resistivity is $10^{13}$ Ω·cm or greater.

The charge generation layer 2 is formed using a coating liquid in which the charge generation material and the binder resin are dispersed in a solvent.

Examples of the solvent for use in dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These are used singly or in a mixture of two or more types.

In addition, as a method of dispersing the charge generation material and the binder resin in a solvent, a common method such as a ball mill dispersion method, an attritor dispersion method, or a sand mill dispersion method is used. Using these dispersion methods, deformation of crystals of the charge generation material due to the dispersion is prevented. Furthermore, at the time of dispersion, it is effective that the average particle diameter of the charge generation material is 0.5 μm or less, preferably 0.3 μm or less, and more preferably 0.15 μm or less.

In addition, in the formation of the charge generation layer 2, a common method such as a blade coating method, a wire bar coating method, a spray coating method, a dipping coating, a bead coating method, an air knife coating method, or a curtain coating method is used.

The thickness of the charge generation layer 2 obtained in this manner is preferably from 0.1 μm to 5.0 μm, and more preferably from 0.2 μm to 2.0 μm.

Charge Transport Layer

The charge transport layer 3 is formed to contain a charge transport material and a binder resin, or contain a polymeric charge transport material.

Examples of the charge transport material include electron-transporting compounds such as quinone compounds e.g., p-benzoquinone, chloranil, bromanil, and anthraquinone, tetracyanoquinodimethane compounds, fluorenone compounds e.g., 2,4,7-trinitrofluorenone, xanthone compounds, benzophenone compounds, cyanovinyl compounds, and ethylene compounds; and hole-transporting compounds such as triarylamine compounds, benzidine compounds, arylalkane compounds, aryl substituted ethylene compounds, stilbene compounds, anthracene compounds, and hydrazone compounds. These charge transport materials may be used singly or in mixture of two or more types, and are not limited thereto.

The charge transport material is preferably a triarylamine derivative represented by the following Structural Formula (a-1) or a benzidine derivative represented by the following Structural Formula (a-2) from the viewpoint of charge mobility.

(a-1)

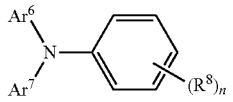

In Structural Formula (a-1), $R^8$ represents a methyl group. n represents 1 or 2. $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, $R^9$ to $R^{13}$ each independently represent a hydrogen atom, a substituted or unsubstituted alkyl group, or a substituted or unsubstituted aryl group. The substituent is a halogen atom, an alkyl group having from 1 to 5 carbon atoms, an alkoxy group having from 1 to 5 carbon atoms, or an amino group substituted with an alkyl group having from 1 to 3 carbon atoms.

(a-2)

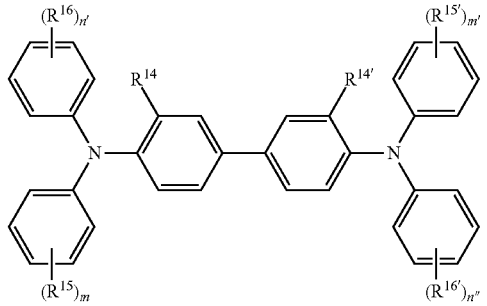

In Structural Formula (a-2), $R^{14}$ and $R^{14'}$ may be the same as or different from each other, and each independently represent a hydrogen atom, a halogen atom, an alkyl group having from 1 to 5 carbon atoms, or an alkoxy group having from 1 to 5 carbon atoms. $R^{15}$, $R^{15'}$, $R^{16}$, and $R^{16'}$ may be the same as or different from each other, and each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{17})=C(R^{18})(R^{19})$, or $—CH=CH—CH=C(R^{20})(R^{21})$, and $R^{17}$ to $R^{21}$ each independently represent a hydrogen atom, a substituted or unsubstituted alkyl group, or a substituted or unsubstituted aryl group. m, m', n' and n" each independently represent an integer of from 0 to 2.

Here, among the triarylamine derivatives represented by the above Structural Formula (a-1) and the benzidine derivatives represented by the above Structural Formula (a-2), triarylamine derivatives having "—$C_6H_4$—CH=CH—CH=C($R^{12}$)($R^{13}$)" and benzidine derivatives having "—CH=CH—CH=C($R^{20}$)($R^{21}$)" are particularly preferable because these are excellent from the viewpoint of charge mobility and adhesiveness to the protective layer.

Examples of the binder resin for use in the charge transport layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole, and polysilane. In addition, as described above, polymeric charge transport materials such as polyester polymeric charge transport materials may be used. These binder resins may be used singly or in a mixture of two or more types. The blending ratio of the charge transport material to the binder resin is preferably 10:1 to 1:5 in terms of weight ratio.

Particularly, although the binder resin is not particularly limited, at least one type of polycarbonate resins having a viscosity average molecular weight of from 50,000 to 80,000 and polyacrylate resins having a viscosity average molecular weight of from 50,000 to 80,000 is preferable because a favorable film is easily obtained.

In addition, as the charge transport material, polymeric charge transport materials may be used. Known materials having a charge transport property such as poly-N-vinyl carbazole and polysilane are used as the polymeric charge transport material. Polyester polymeric charge transport materials disclosed in JP-A-8-176293, JP-A-8-208820 and the like, having a high charge transport property in comparison to other types, are particularly preferable. The polymeric charge transport polymer material may form a film independently, but may also be mixed with a binder resin to be described later to form a film.

The charge transport layer 3 is formed using a coating liquid for charge transport layer formation containing the above-described constituent materials. Examples of the solvent for use in the coating liquid for charge transport layer formation include usual organic solvents such as aromatic hydrocarbons e.g., benzene, toluene, xylene, and chlorobenzene, ketones e.g., acetone and 2-butanone, halogenated aliphatic hydrocarbons e.g., methylene chloride, chloroform, and ethylene chloride, cyclic or linear ethers e.g., tetrahydrofuran and ethyl ether. These usual organic solvents are used singly or in mixture of two or more types. In addition, known methods are used as a method of dispersing the above-described constituent materials.

A common method such as a blade coating method, a wire bar coating method, a spray coating method, a dipping coating method, a bead coating method, an air knife coating method, or a curtain coating method is used as an applying method when the coating liquid for charge transport layer formation is applied to the charge generation layer 2.

The thickness of the charge transport layer 3 is preferably from 5 μm to 50 μm, and more preferably from 10 μm to 30 μm.

Protective Layer

The protective layer 5 used as a surface layer of the electrophotographic photoreceptor 7 has resistance to wear, scratches and the like of the outermost surface, and is provided to increase toner transfer efficiency.

The protective layer 5 includes a cross-linked component using a coating liquid that includes compound A and compound B. The compound A is at least one compound selected from guanamine compounds and melamine compounds and the compound B is at least one compound of charge-transporting material having at least one substituent selected from —OH, —$OCH_3$, —$NH_2$, —SH, and —COOH.

The guanamine compound will be described.

The guanamine compound is a compound having a guanamine skeleton (structure). Examples thereof include acetoguanamine, benzoguanamine, formoguanamine, steroguanamine, spiroguanamine, and cyclohexylguanamine.

The guanamine compound is preferably at least one kind of compounds represented by the following Formula (A) and oligomers thereof. Here, the oligomer is produced by polymerizing the compound represented by Formula (A) as a structural unit, and the polymerization degree thereof is, for example, from 2 to 200 (preferably from 2 to 100). The compounds represented by Formula (A) may be used singly or in combination of two or more types. Particularly, when the compounds represented by Formula (A) are used in mixture of two or more types, or used as an oligomer having the compound as a structural unit, solubility in a solvent is improved.

(A)

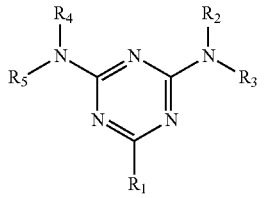

In Formula (A), $R_1$ represents a linear or branched alkyl group having from 1 to 10 carbon atoms, a substituted or unsubstituted phenyl group having 6 to 10 carbon atoms, or a substituted or unsubstituted alicyclic hydrocarbon group having from 4 to 10 carbon atoms. $R_2$ to $R_5$ each independently represent a hydrogen atom, —$CH_2$—OH, or —$CH_2$—O—$R_6$. $R_6$ represents a hydrogen atom or a linear or branched alkyl group having from 1 to 10 carbon atoms.

In Formula (A), the alkyl group represented by $R_1$ has from 1 to 10 carbon atoms, preferably from 1 to 8 carbon atoms, and more preferably from 1 to 5 carbon atoms. The alkyl group may be linear or branched.

In Formula (A), the phenyl group represented by $R_1$ has from 6 to 10 carbon atoms, and preferably from 6 to 8 carbon atoms. Examples of the substituent of the phenyl group include a methyl group, an ethyl group, and a propyl group.

In Formula (A), the alicyclic hydrocarbon group represented by $R_1$ has from 4 to 10 carbon atoms, and preferably from 5 to 8 carbon atoms. Examples of the substituent of the alicyclic hydrocarbon group include a methyl group, an ethyl group, and a propyl group.

In Formula (A), in "—$CH_2$—O—$R_6$" represented by $R_2$ to $R_5$, the alkyl group represented by $R_6$ has from 1 to 10 carbon atoms, preferably from 1 to 8 carbon atoms, and more preferably from 1 to 6 carbon atoms. In addition, the alkyl group may be linear or branched. Preferable examples thereof include a methyl group, an ethyl group, and a butyl group.

The compound represented by Formula (A) is particularly preferably a compound in which $R_1$ represents a substituted or unsubstituted phenyl group having from 6 to 10 carbon atoms, and $R_2$ to $R_5$ each independently represent —$CH_2$—O—$R_6$. $R_6$ is preferably selected from a methyl group and an n-butyl group.

The compound represented by Formula (A) is synthesized by, for example, a known method using guanamine and formaldehyde (for example, see Experimental Chemical Lectures, 4th Edition, vol. 28, p. 430).

Hereinafter, specific examples of the compound represented by Formula (A) will be shown, but are not limited thereto. In addition, although the following specific examples are in the form of a monomer, the compounds may be oligomers having these monomers as a structural unit.

(A)-1

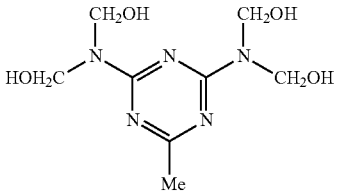

(A)-2

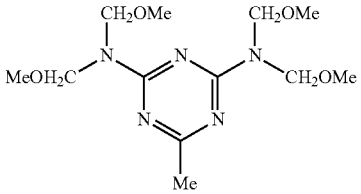

(A)-3

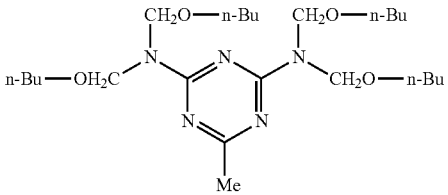

(A)-4

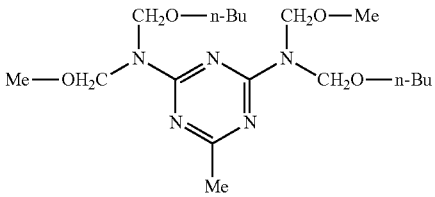

(A)-5

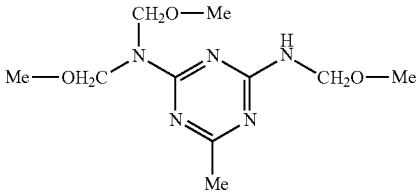

(A)-6

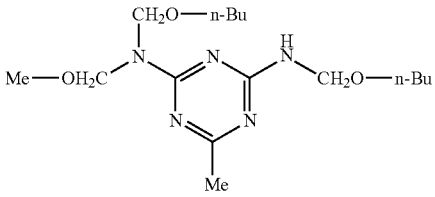

-continued (A)-7

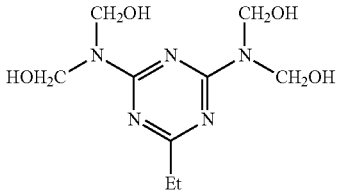

(A)-8

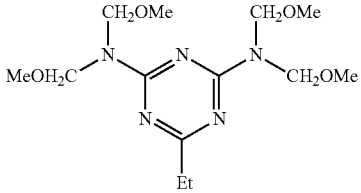

(A)-9

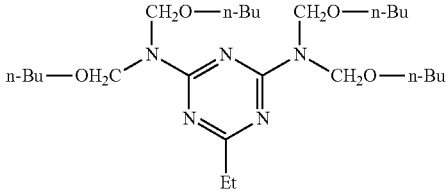

(A)-10

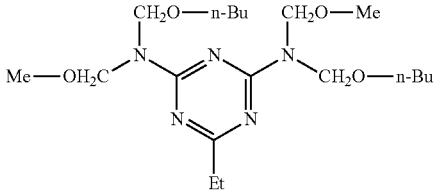

(A)-11

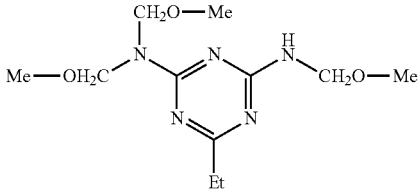

(A)-12

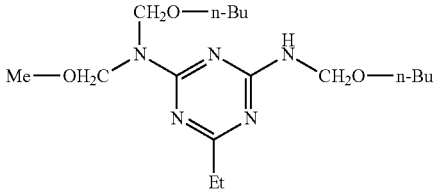

(A)-13

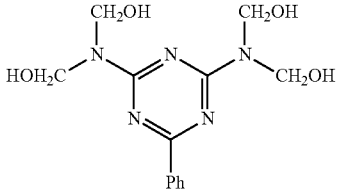

(A)-14

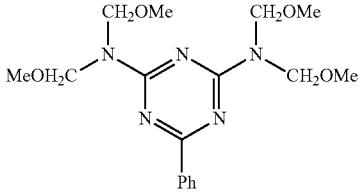

-continued
(A)-15
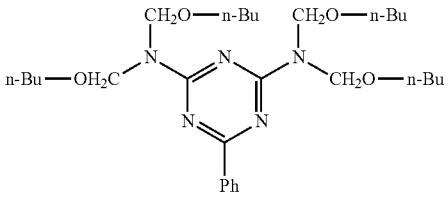
(A)-16
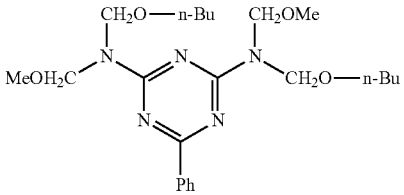
(A)-17
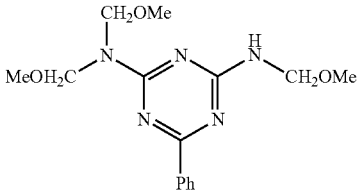
(A)-18
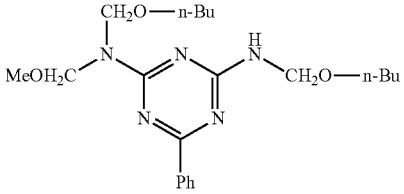
(A)-19
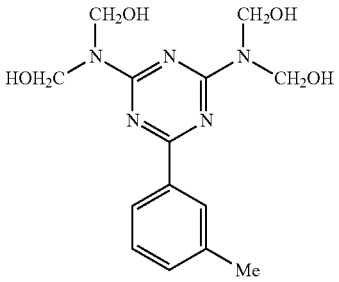
(A)-20
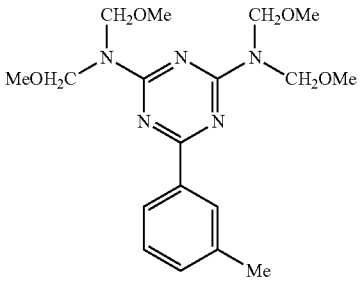
-continued
(A)-21
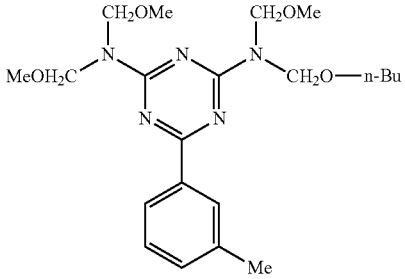
(A)-22
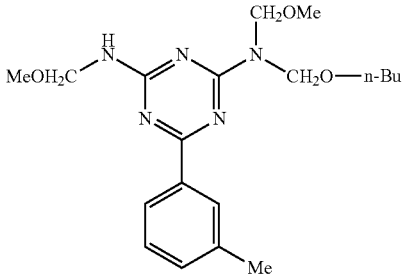
(A)-23
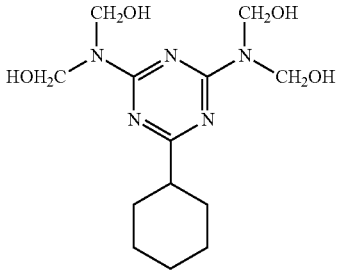
(A)-24
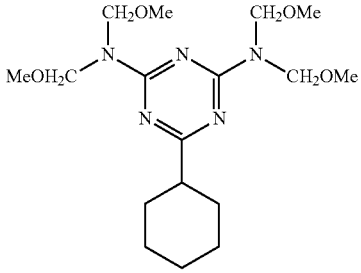
(A)-25
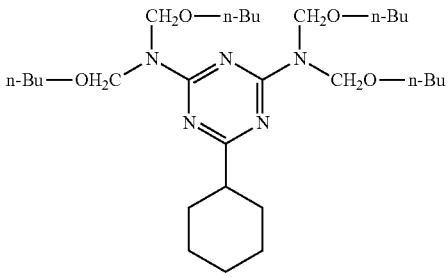

-continued
(A)-26
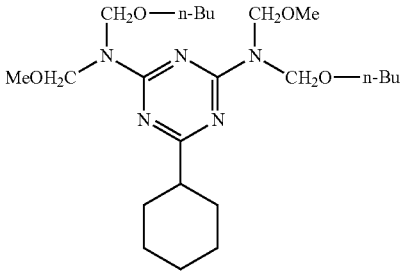
(A)-27
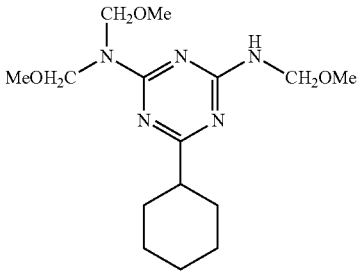
(A)-28
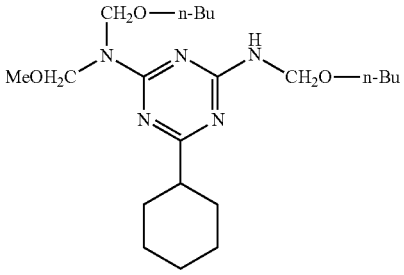
(A)-29
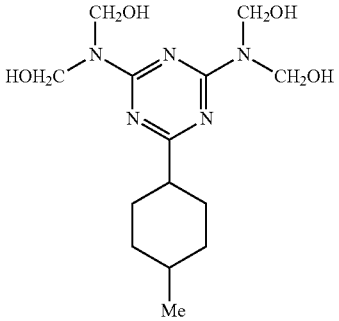
(A)-30
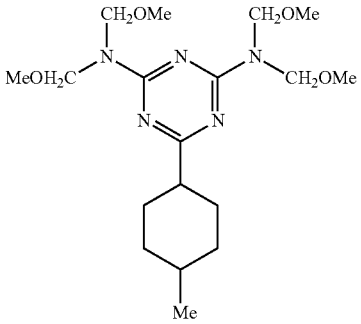
-continued
(A)-31
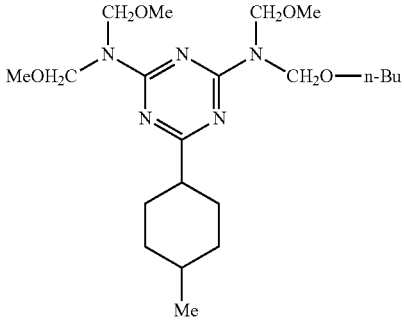
(A)-32
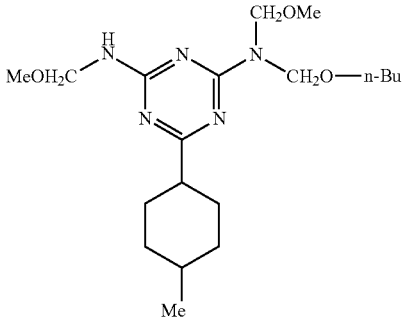
(A)-33
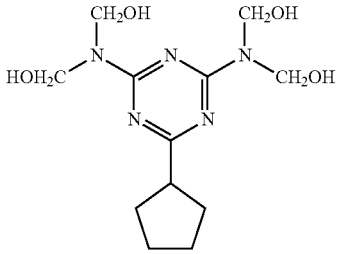
(A)-34
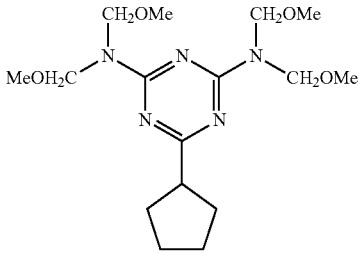
(A)-35
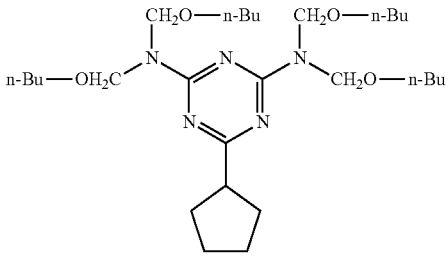

-continued (A)-36

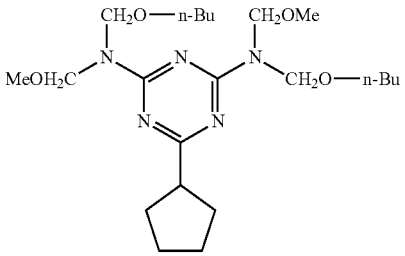

(A)-37

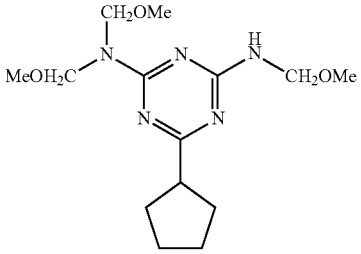

(A)-38

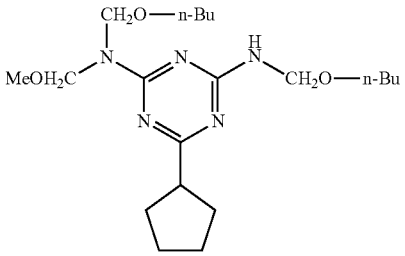

(A)-39

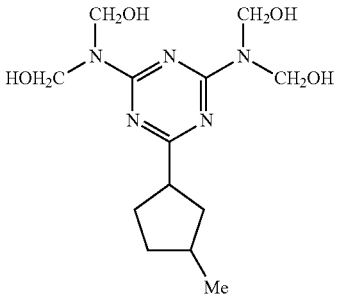

(A)-40

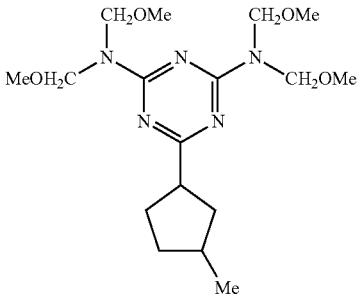

-continued (A)-41

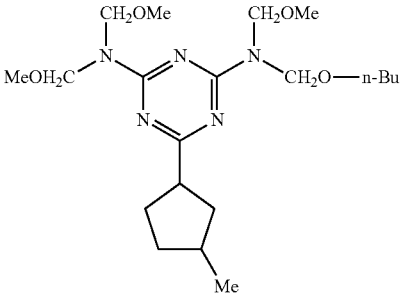

(A)-42

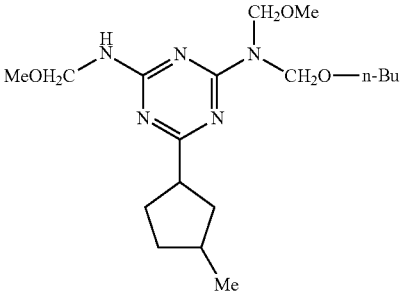

Examples of the commercially available products of the compound represented by Formula (A) include "SUPER BECKAMINE (R) L-148-55, SUPER BECKAMINE (R) 13-535, SUPER BECKAMINE (R) L-145-60, and SUPER BECKAMINE (R) TD-126" (all manufactured by DIC Corporation); and "NIKALAC BL-60, and NIKALAC BX-4000" (all manufactured by Nippon Carbide Industries Co., Inc.).

In addition, the compound represented by Formula (A) (including oligomers) may be dissolved in an appropriate solvent such as toluene, xylene or ethyl acetate, and washed with distilled water, ion exchange water or the like, or may be treated with an ion exchange resin, in order to remove the effect of a residual catalyst after synthesizing or purchasing the commercially available product.

Next, the melamine compound will be described.

The melamine compound has a melamine skeleton (structure), and is particularly preferably at least one kind of compounds represented by the following Formula (B) and oligomers thereof. Here, the oligomer is an oligomer in which the compound represented by Formula (B) is polymerized as a structural unit as in the case of the compound represented by Formula (A), and the polymerization degree thereof is, for example, from 2 to 200 (preferably from 2 to 100). The compounds represented by Formula (B) or oligomers thereof may be used singly or in combination of two or more types. In addition, the compounds represented by Formula (B) or oligomers thereof may be used in combination with compounds represented by Formula (A) or oligomers thereof. Particularly, when the compounds represented by Formula (B) are used in mixture of two or more types, or used as an oligomer having the compound as a structural unit, solubility in a solvent is improved.

(B)

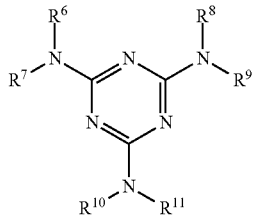

In Formula (B), $R^6$ to $R^{11}$ each independently represent a hydrogen atom, —$CH_2$—OH, or —$CH_2$—O—$R^{12}$, and $R^{12}$ represents an alkyl group having from 1 to 5 carbon atoms that may be branched. Examples of $R^{12}$ include a methyl group, an ethyl group, and a butyl group.

The compound represented by Formula (B) is synthesized by, for example, a known method using melamine and formaldehyde (for example, in the same manner as in the case of the melamine resin as described in Experimental Chemical Lectures, $4^{th}$ Edition, vol. 28, p. 430).

Hereinafter, specific examples of the compound represented by Formula (B) will be shown, but are not limited thereto. Although the following specific examples are in the form of a monomer, the compounds may be oligomers having these monomers as a structural unit.

(B)-1

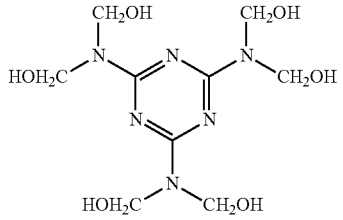

(B)-2

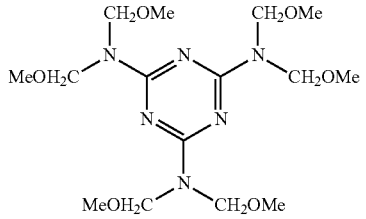

(B)-3

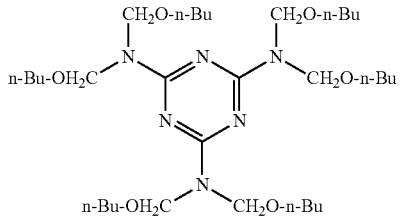

(B)-4

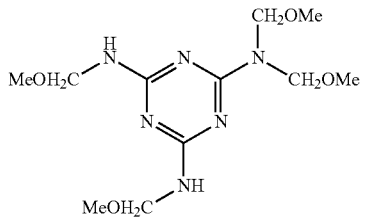

-continued (B)-5

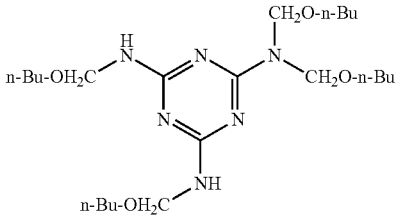

(B)-6

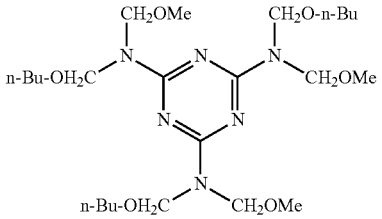

(B)-7

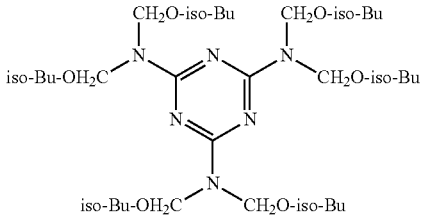

Examples of the commercially available product of the compound represented by Formula (B) include SUPER-MELAMI No. 90 (manufactured by NOF Corporation), SUPER BECKAMINE (R) TD-139-60 (manufactured by DIC Corporation), U-VAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.).

In addition, the compound represented by Formula (B) (including oligomers) may be dissolved in an appropriate solvent such as toluene, xylene or ethyl acetate, and washed with distilled water, ion exchanged water or the like, or may be treated with an ion exchange resin, in order to remove the effect of a residual catalyst after synthesizing or purchasing the commercially available product.

Next, the specific charge-transporting material will be described. Preferable examples of the specific charge-transporting material include materials having at least one substituent selected from —OH, —$OCH_3$, —$NH_2$, —SH, and —COOH. Particularly, the specific charge-transporting material preferably has at least two (or three) substituents selected from —OH, —$OCH_3$, —$NH_2$, —SH, and —COOH. In this manner, when the number of reactive functional groups (the substituents) in the specific charge-transporting material is increased, the crosslink density rises, and thus a cross-linked film having a higher strength is obtained. Particularly, when a blade cleaner is used, the rotary torque of the electrophotographic photoreceptor is reduced, thereby suppressing damage to the blade or wear of the electrophotographic photoreceptor. The detailed reason for this is not clear, but it is presumed that this is because when the number of reactive functional groups is increased, a cured film having a high crosslink density is obtained, and thus molecular motion of the top surface of the electrophotographic photoreceptor is suppressed and a reciprocal action with the surface molecules of the blade member weakens.

The specific charge-transporting material is preferably a compound represented by the following Formula (I):

$$F—((—R_1—X)_{n1}R_2—Y)_{n2} \quad (I)$$

In Formula (I), F represents an organic group derived from a compound having a hole transport ability, $R_1$ and $R_2$ each independently represent a linear or branched alkylene group having from 1 to 5 carbon atoms, n1 represents 0 or 1, and n2 represents an integer of from 1 to 4. X represents an oxygen atom, NH, or a sulfur atom, and Y represents —OH, —$OCH_3$—$NH_2$, —SH, or —COOH.

In Formula (I), in the organic group derived from a compound having a hole transport ability that is represented by F, arylamine derivatives are preferably used as the compound having a hole transport ability. A triphenylamine derivative and a tetraphenylbenzidine derivative are preferably used as the arylamine derivative.

In addition, the compound represented by Formula (I) is preferably a compound represented by the following Formula (II). Particularly, the compound represented by the following Formula (II) is excellent in charge mobility, stability against oxidation, and the like.

(II)

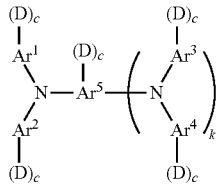

In Formula (II), $Ar^1$ to $Ar^4$ may be the same as or different from each other, and each independently represent a substituted or unsubstituted aryl group, $Ar^5$ represents a substituted or unsubstituted aryl group, or a substituted or unsubstituted arylene group, D represents —(—$R_1$—X)$_{n1}$$R_2$—Y, c independently represents 0 or 1, k represents 0 or 1, and the total number of ID is from 1 to 4. In addition, $R_1$ and $R_2$ each independently represent a linear or branched alkylene group having from 1 to 5 carbon atoms, n1 represents 0 or 1, X represents an oxygen atom, NH, or a sulfur atom, and Y represents —OH, —$OCH_3$, —$NH_2$, —SH, or —COOH.

In Formula (II), "—(—$R_1$—X)$_{n1}$$R_2$—Y" represented by D is defined in the same manner as in Formula (I), $R_1$ and $R_2$ each independently represent a linear or branched alkylene group having from 1 to 5 carbon atoms. In addition, n1 is preferably 1, X is preferably an oxygen atom, and Y is preferably a hydroxyl group. The total number of D in Formula (II) corresponds to n2 in Formula (I), that is preferably from 2 to 4 and more preferably from 3 to 4. That is, when the total number of D in Formulae (I) and (II) is preferably from 2 to 4, and more preferably from 3 to 4 in one molecule, the crosslink density rises, and thus a cross-linked film having a higher strength is obtained. Particularly, when a blade cleaner is used, the rotary torque of the electrophotographic photoreceptor is reduced, thereby suppressing damage to the blade or wear of the electrophotographic photoreceptor. The detailed reason for this is not clear, but it is presumed that this is because when the number of reactive functional groups is increased, a cured film having a high cross link density is obtained, and thus molecular motion of the top surface of the electrophotographic photoreceptor is suppressed and a reciprocal action with the surface molecules of the blade member weakens.

In Formula (II), each of $Ar_1$ to $Ar_4$ is preferably one of the compounds represented by the following Formulae (1) to (7). In the following Formulae (1) to (7), "-$(D)_c$." that may be connected to $Ar_1$ to $Ar_4$ is represented by "-$(D)_c$".

(1)

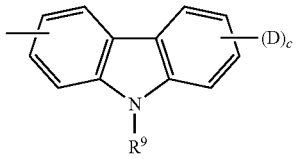

(2)

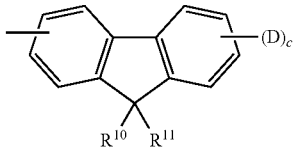

(3)

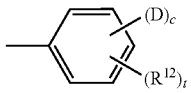

(4)

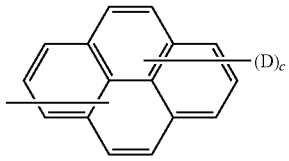

(5)

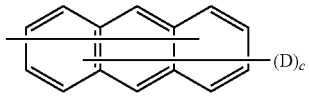

(6)

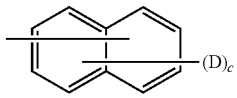

(7)

—Ar—$(Z')_s$—Ar—$(D)_c$

In Formulae (1) to (7), represents one type selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms, $R^{10}$ to $R^{12}$ each represent one type selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom. Ar represents a substituted or unsubstituted arylene group, D and c are the same as "D" and "c" in Formula (II) respectively, s represents 0 or 1, and t represents an integer of from 1 to 3.

Here, Ar in Formula (7) is preferably represented by the following Formula (8) or (9).

(8)

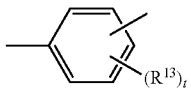

-continued (9)

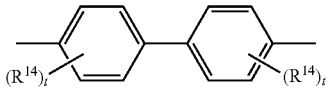

In Formulae (8) and (9), $R^{13}$ and $R^{14}$ each represent one type selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t represents an integer of from 1 to 3.

In addition, Z' in Formula (7) is preferably represented by any one of the following Formulae (10) to (17).

(10) $—(CH_2)_q—$

(11) $—(CH_2CH_2O)_r—$ (12)

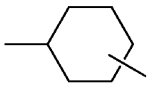

(13)

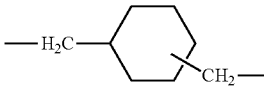

(14)

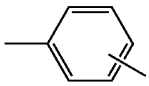

(15)

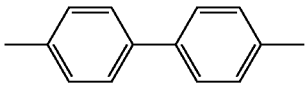

(16)

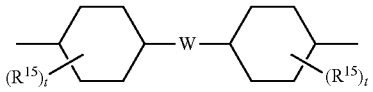

(17)

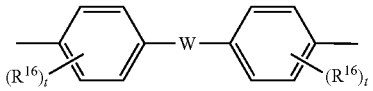

In Formulae (10) to (17), $R^{15}$ and $R^{16}$ each represent one type selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, W represents a divalent group, q and r each represent an integer of from 1 to 10, and t represents an integer of from 1 to 3.

W in the above Formulae (16) and (17) is preferably any one of divalent groups represented by the following Formulae (18) to (26). However, in Formula (25), u represents an integer of from 0 to 3.

(18) $—CH_2—$

(19) $—C(CH_3)_2—$

-continued

(20) —O—

(21) —S—

(22) $—C(CF_3)_2—$

(23) $—Si(CH_3)_2—$ (24)

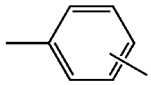

(25)

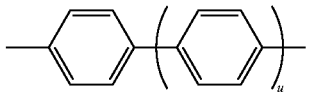

(26)

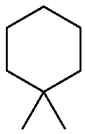

In addition, in Formula (II), $Ar^5$ is an aryl group represented by any one of the aryl groups (1) to (7) exemplified in the description of $Ar^1$ to $Ar^4$ when k is 0. When k is 1, $Ar^5$ is an arylene group obtained by removing a hydrogen atom from one of the aryl groups (1) to (7).

Specific examples of the compound represented by Formula (I) include the following compounds (I)-1 to (I)-34. The compound represented by the above Formula (I) is not limited thereto.

I-1

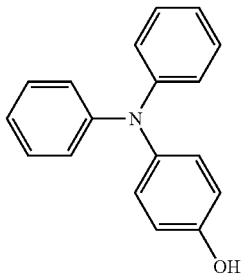

I-2

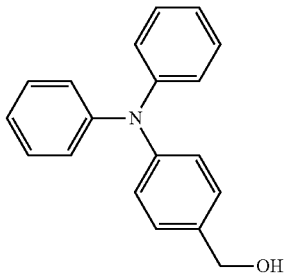

I-3

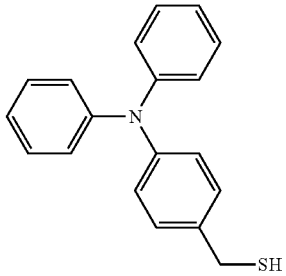

-continued
I-4
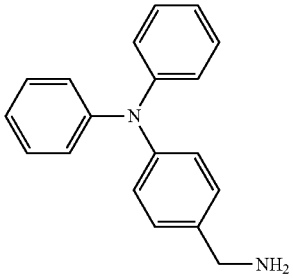
I-5
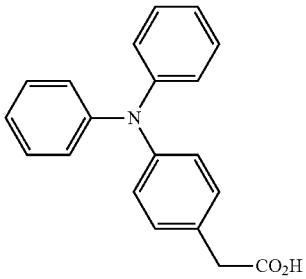
I-6
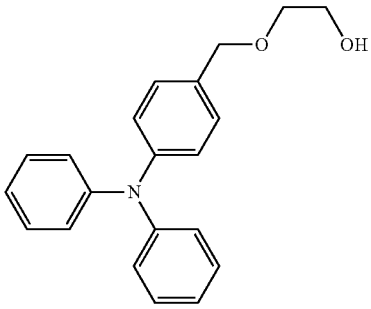
I-7
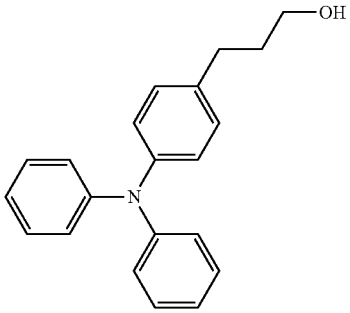
I-8
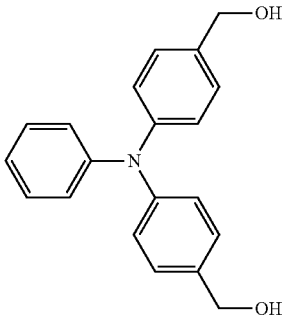
-continued
I-9
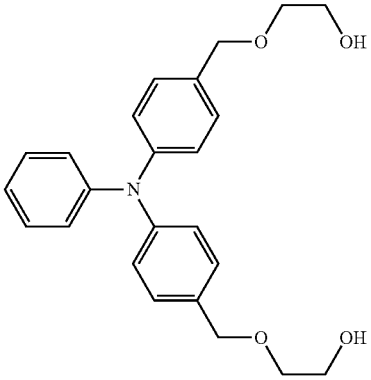
I-10
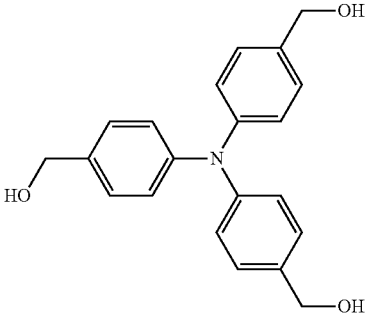
I-11
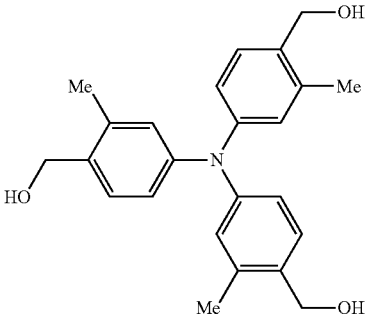
I-12
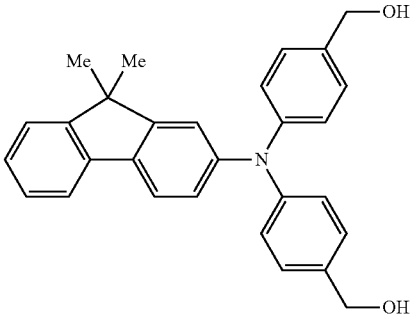

-continued
I-13
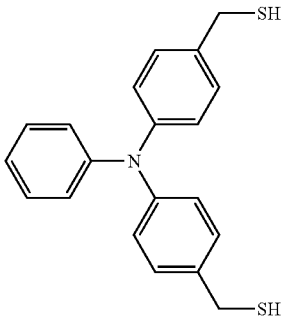
I-14
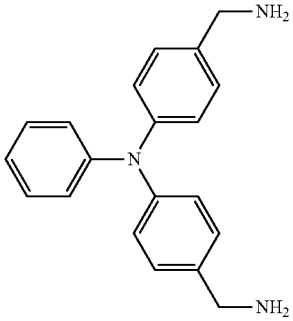
I-15
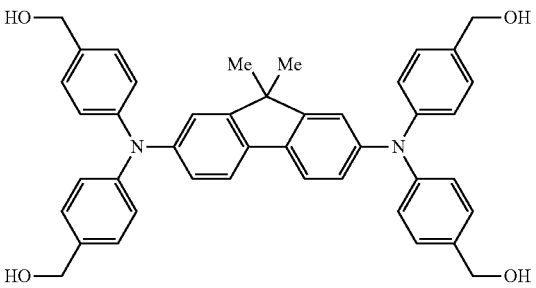
I-16
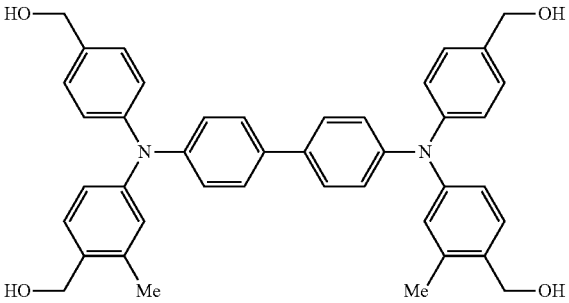
I-17
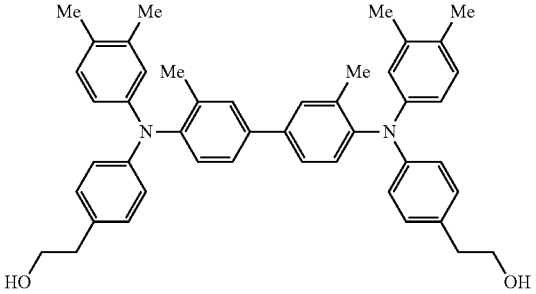
-continued
I-18
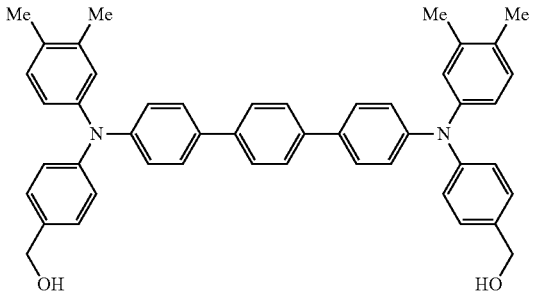
I-19
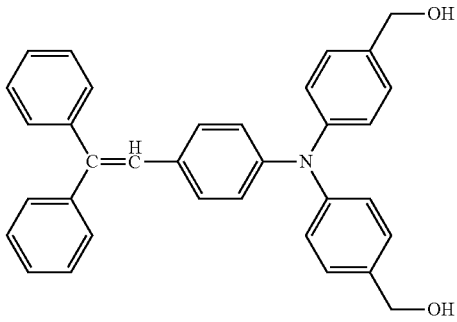
I-20
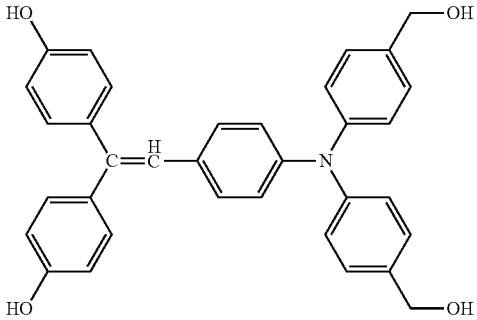
I-21
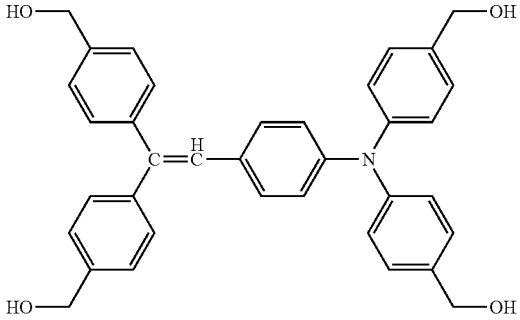
I-22
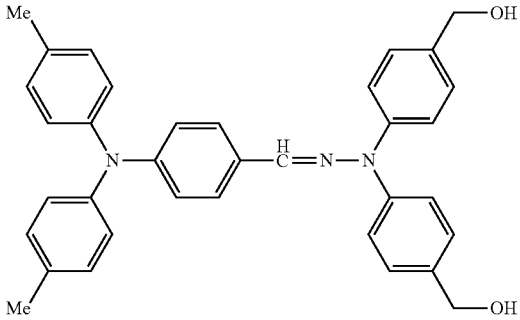

-continued
I-23
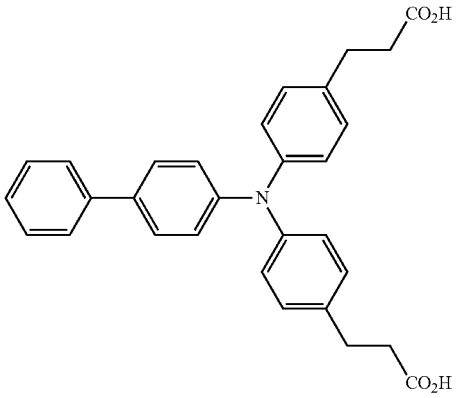
I-24
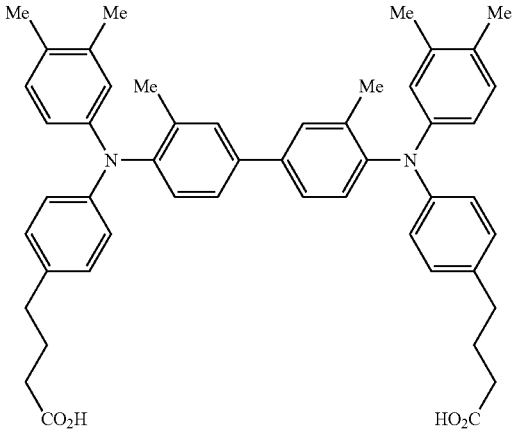
I-25
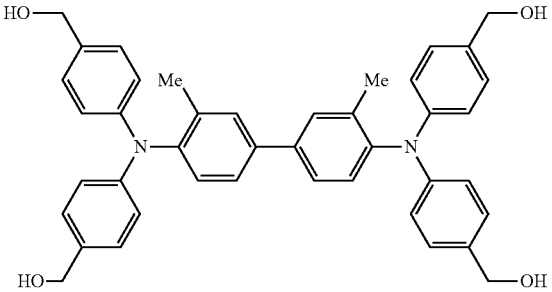
I-26
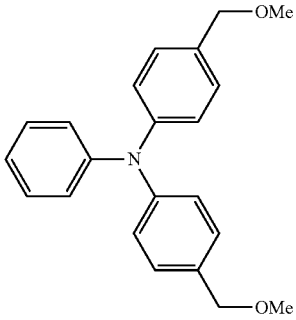
-continued
I-27
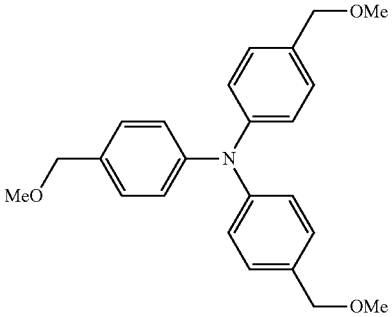
I-28
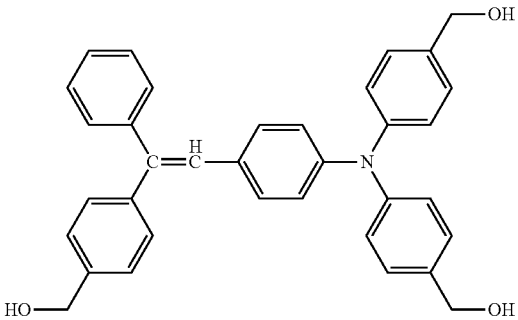
I-29
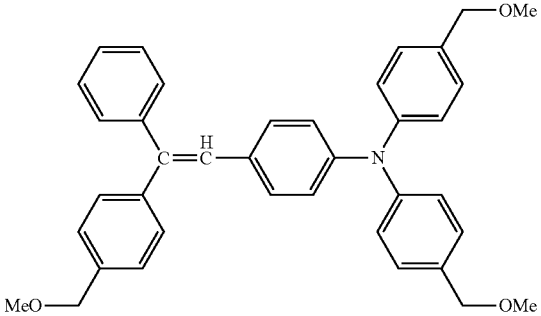
I-30
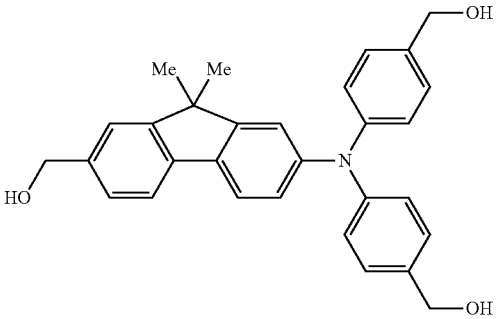

-continued

I-31

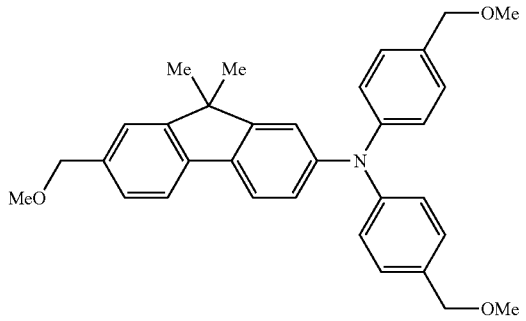

I-32

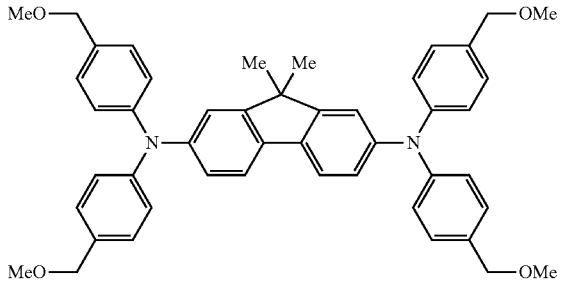

I-33

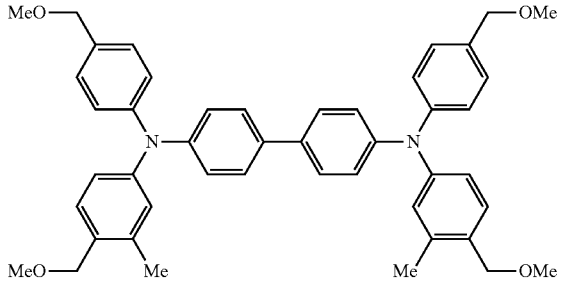

I-34

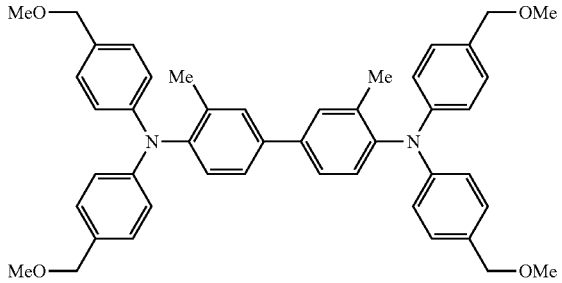

Hereinafter, a more detailed description of the protective layer 5 will be given.

In the protective layer 5, other thermosetting resins such as a phenol resin, a melamine resin, and a benzoguanamine resin may be used in mixture in order to effectively suppress oxidation due to excessive adsorption of the gas generated by electric discharge.

It is preferable that a surfactant be added to the protective layer 5 in order to improve the film forming property. The surfactant to be used is not particularly limited as long as it contains at least one structure of a fluorine atom, an alkylene oxide structure, and a silicone structure. However, the surfactant preferably has two or more of the above structures, because such a surfactant has high affinity and high compatibility with an organic charge-transporting compound, thereby improving the film forming property of a coating liquid for protective layer formation and suppressing the formation of wrinkles and unevenness of the protective layer 5.

There are various surfactants that are surfactants having a fluorine atom. Specific examples of the surfactant having a fluorine atom and an acrylic structure include POLYFLOW KL600 (manufactured by Kyoeisha Chemical Co., Ltd.), and EFTOP series (manufactured by JEMCO Inc.). Typical examples of the surfactant having an acrylic structure include surfactants obtained by polymerizing or copolymerizing monomers such as acrylic or methacrylic compounds.

In addition, specific preferable examples of the surfactant having a perfluoroalkyl group as a fluorine atom include perfluoroalkyl sulfonic acids (for example, perfluorobutane sulfonic acid and perfluorooctane sulfonic acid), perfluoroalkyl carboxylic acids (for example, perfluorobutane carboxylic acid and perfluorooctane carboxylic acid) and perfluoroalkyl group-containing phosphoric esters. Perfluoroalkyl sulfonic acids and the perfluoroalkyl carboxylic acids may be salts or amide-modified products thereof.

Examples of the commercially available product of the surfactant having a perfluoroalkyl group include Megafac series (manufactured by DIC Corporation), EFTOP series (manufactured by JEMCO Inc.), FTERGENT series (manufactured by NEOS Co., Ltd.), Surflon series (manufactured by ACC Seimi Chemical Co., Ltd.), PF series (manufactured by Kitamura Chemicals Co., Ltd.), and FC series (manufactured by 3M company).

Examples of the surfactant having an alkylene oxide structure include polyethylene glycols, polyether defoaming agents, and polyether-modified silicone oils. The number average molecular weight of the polyethylene glycol is preferably 2,000 or less, and examples of the polyethylene glycol having a number average molecular weight of 2,000 or less include polyethylene glycol 2000 (number average molecular weight of 2,000), polyethylene glycol 600 (number average molecular weight of 600), polyethylene glycol 400 (number average molecular weight of 400), and polyethylene glycol 200 (number average molecular weight of 200).

In addition, examples of the polyether defoaming agent include PE series (manufactured by Wako Pure Chemical Industries, Ltd.) and defoaming agent series (manufactured by Kao Corporation).

Examples of the surfactant having a silicone structure include usual silicone oils, such as dimethyl silicone, methyl phenyl silicone, diphenyl silicone, and derivatives thereof.

Examples of the surfactant having both of an alkylene oxide structure and a silicone structure include KF series 351(A), KF352(A), KF353(A), KF354(A), KF355(A), KF615(A), KF618, KF945(A), and KF6004 (all manufactured by Shin-Etsu Chemical Co., Ltd.); TSF series (manufactured by GE Toshiba Silicone Co., Ltd.); and BYK series and UV series (manufactured by BYK-Chemie Japan K.K.).

The content of the surfactants is preferably from 0.01% by weight to 1% by weight, and more preferably from 0.02% by weight to 0.5% by weight with respect to the total solid content of the protective layer 5. When the content of the surfactant containing a fluorine atom is 0.01% by weight or greater, the effect of preventing coating film defects such as wrinkles and unevenness tends to be enhanced. In addition, when the content of the surfactant having a fluorine atom is 1% by weight or less, separation between the surfactant having a fluorine atom and a curable resin does not easily occur, whereby the strength of the obtained cured product tends to be maintained.

For the protective layer 5, a curing catalyst may be used to promote curing of guanamine compounds (represented by Formula (A)), melamine compounds (represented by Formula (B)), and specific charge transport materials. As the curing catalyst, acid catalysts are preferably used. Examples of the acid catalyst include aliphatic carboxylic acids such as acetic acid, chloroacetic acid, trichloroacetic acid, trifluoroacetic acid, oxalic acid, maleic acid, malonic acid, and lactic acid, aromatic carboxylic acids such as benzoic acid, phthalic acid, terephthalic acid, and trimellitic acid, and aliphatic and aromatic sulfonic acids such as methanesulfonic acid, dodecylsulfonic acid, benzenesulfonic acid, dodecylbenzenesulfonic acid, and naphthalenesulfonic acid. Sulfur-containing materials are preferably used.

When a sulfur-containing material is used as the curing catalyst, the sulfur-containing material exhibits excellent functions as the curing catalyst for guanamine compounds (represented by Formula (A)), melamine compounds (represented by Formula (B)), and specific charge transport materials, and promotes the curing reaction, thereby improving the mechanical strength of the obtained protective layer 5. Furthermore, when a compound represented by the above Formula (I) (including Formula (II)) is used as the charge-transporting material, the sulfur-containing material also exhibits excellent functions as a dopant for the charge-transporting material, thereby improving the electrical characteristics of the obtained functional layer. As a result, when the electrophotographic photoreceptor is formed, it has high levels of mechanical strength, film-forming property, and electrical characteristics.

The sulfur-containing material as the curing catalyst is preferably acidic at room temperature (for example, 25° C.) or after heating, and is most preferably at least one type of organic sulfonic acids and derivatives thereof from the viewpoint of adhesiveness, ghosting, and electrical characteristics. The presence of the catalyst in the protective layer 5 is easily confirmed by, for example, XPS.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among them, p-toluenesulfonic acid and dodecylbenzenesulfonic acid are preferable from the viewpoint of catalytic activity and film forming property. In addition, organic sulfonates may also be used as long as these may dissociate to some degree in the curable resin composition.

In addition, when using a so-called heat latent catalyst that exhibits an increased catalytic ability when a certain temperature or higher is applied, both a reduction in the curing temperature and storage stability are achieved, because the catalytic activity at a temperature at which the liquid is in storage is low, while the catalytic activity at the time of curing is high.

Examples of the heat latent catalyst include microcapsules in which an organic sulfone compound or the like is coated with a polymer in the form of particles, porous compounds such as zeolite onto which acid or the like is adsorbed, heat latent protonic acid catalysts in which protonic acid and/or a derivative thereof are blocked with a base, protonic acid and/or a derivative thereof esterified with a primary or secondary alcohol, protonic acid and/or a derivative thereof blocked with vinyl ethers and/or vinyl thioethers, monoethyl amine complexes of boron trifluoride, and pyridine complexes of boron trifluoride.

Among them, from the viewpoint of catalytic activity, storage stability, availability, and cost efficiency, protonic acid and/or a derivative thereof blocked with a base are preferable.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzene sulfonic acid, o-, m-, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the protonic acid derivative include neutralized alkali metal salts or alkali earth metal salts of protonic acids such as sulfonic acid and phosphoric acid, and polymeric compounds in which a protonic acid skeleton is introduced into a polymer chain (e.g., polyvinylsulfonic acid).

The amines are classified into primary, secondary, and tertiary amines. Any of these amines can be used without limitation.

Examples of the primary amines include methylamine, ethylamine, propylamine, isopropylamine, n-butylamine, isobutylamine, t-butylamine, hexylamine, 2-ethylhexylamine, secondary butylamine, allylamine, and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the commercially available product include "NACURE 2501" (toluenesulfonic acid dissociation, methanol/isopropanol solvent, pH of 6.0 to 7.2, dissociation temperature of 80° C.), "NACURE 2107" (p-toluenesulfonic acid dissociation, isopropanol solvent, pH of 8.0 to 9.0, dissociation temperature of 90° C.), "NACURE 2500" (p-toluenesulfonic acid dissociation, isopropanol solvent, pH of 6.0 to 7.0, dissociation temperature of 65° C.), "NACURE 2530" (p-toluenesulfonic acid dissociation, methanol/isopropanol solvent, pH of 5.7 to 6.5, dissociation temperature of 65° C.), "NACURE 2547" (p-toluenesulfonic acid dissociation, aqueous solution, pH of 8.0 to 9.0, dissociation temperature of 107° C.), "NACURE 2558" (p-toluene sulfonic acid dissociation, ethyleneglycol solvent, pH of 3.5 to 4.5, dissociation temperature of 80° C.), "NACURE XP-357" (p-toluenesulfonic acid dissociation, methanol solvent, pH of 2.0 to 4.0, dissociation temperature of 65° C.) "NACURE XP-386" (p-toluenesulfonic acid dissociation, aqueous solution, pH of 6.1 to 6.4, dissociation temperature of 80° C.), "NACURE XC-2211" (p-toluenesulfonic acid dissociation, pH of 7.2 to 8.5, dissociation temperature of 80° C.), "NACURE 5225" (dodecylbenzenesulfonic acid dissociation, isopropanol solvent, pH of 6.0 to 7.0, dissociation temperature of 120° C.) "NACURE 5414" (dodecylbenzenesulfonic acid dissociation, xylene solvent, dissociation temperature of 120° C.), "NACURE 5528" (dodecylbenzenesulfonic acid dissociation, isopropanol solvent, pH of 7.0 to 8.0, dissociation temperature of 120° C.), "NACURE 5925" (dodecylbenzenesulfonic acid dissociation, pH of 7.0 to 7.5, dissociation temperature of 130° C.), "NACURE 1323" (dinonylnaphthalene sulfonic acid dissociation, xylene solvent, pH of 6.8 to 7.5, dissociation temperature of 150° C.), "NACURE 1419" (dinonylnaphthalenesulfonic acid dissociation, xylene/methylisobutylketone solvent, dissociation temperature of 150° C.), "NACURE 1557" (dinonylnaphthalenesulfonic acid dissociation, butanol/2-butoxyethanol solvent, pH of 6.5 to 7.5, dissociation temperature of 150° C.), "NACURE X49-110" (dinonylnaphthalenedisulfonic acid dissociation, isobutanol/isopropanol solvent, pH of 6.5 to 7.5, dissociation temperature of 90° C.), "NACURE 3525" (dinonylnaphthalenedisulfonic acid dissociation, isobutanol/isopropanol solvent, pH of 7.0 to 8.5, dissociation temperature of 120° C.), "NACURE XP-383" (dinonylnaphthalenedisulfonic acid dissociation, xylene solvent, dissociation temperature of 120° C.), "NACURE 3327" (dinonylnaphthalenedisulfonic acid dissociation, isobutanol/isopropanol solvent, pH of 6.5 to 7.5, dissociation temperature of 150° C.), "NACURE 4167" (phosphoric acid dissociation, isopropanol/isobutanol solvent, pH of 6.8 to 7.3, dissociation temperature of 80° C.), "NACURE XP-297" (phosphoric acid dissociation, water/isopropanol solvent, pH of 6.5 to 7.5, dissociation temperature of 90° C.), and "NACURE 4575" (phosphoric acid dissociation, pH of 7.0 to 8.0, dissociation temperature of 110° C.) (manufactured by King Industries, Inc.).

These heat latent catalysts are used singly or in combination of two or more types.

Here, the amount of the catalyst blended is preferably from 0.1% by weight to 50% by weight, and particularly preferably from 10% by weight to 30% by weight with respect to the amount of at least one kind selected from the guanamine compounds (represented by Formula (A)) and the melamine compounds (represented by Formula (B)) (solid content concentration in the coating liquid). When the amount is less than the above range, the catalytic activity may become too low, and when the amount is greater than the above range, light resistance may deteriorate. The light resistance is a phenomenon in which when a photosensitive layer is irradiated with light from the outside such as indoor light, the density of the part irradiated with the light is reduced. The cause for this is not clear, but it is presumed that this is because a phenomenon similar to the optical memory effect occurs as in JP-A-5-099737.

The protective layer 5 having the above-described configuration is formed using a coating liquid for film formation containing at least one compound selected from the guanamine compounds (represented by Formula (A)) and the melamine compounds (represented by Formula (B)) and at least one compound of the specific charge-transporting material. If necessary, constituent components of the protective layer 5 are added to the coating liquid for film formation.

The coating liquid for film formation may be prepared without using a solvent, or as necessary using a solvent such as alcohols such as methanol, ethanol, propanol, or butanol, ketones such as acetone or methyl ethyl ketone, or ethers such as tetrahydrofuran, diethyl ether, or dioxane. The solvents may be used singly or in mixture of two or more types. The solvent preferably has a boiling point of 100° C. or lower, and as the solvent, a solvent (for example, alcohols) having at least one or more kinds of hydroxy groups may be used.

Although the amount of the solvent is arbitrarily set, the amount is from 0.5 part by weight to 30 parts by weight, and preferably from 1 part by weight to 20 parts by weight with respect to 1 part by weight of at least one kind selected from the guanamine compounds (represented by Formula (A)) and the melamine compounds (represented by Formula (B)), because when the amount is too small, the guanamine compound (represented by Formula (A)) and the melamine compound (represented by Formula (B)) are easily precipitated.

In addition, when the above components are reacted to obtain a coating liquid, the components may be simply mixed and dissolved, or may be mixed and dissolved under heat at a temperature from room temperature (for example, 25° C.) to 100° C., and preferably from 30° C. to 80° C. for 10 minutes to 100 hours or less, and preferably 1 hour to 50 hours. During heating, it is also preferable to apply ultrasonic waves. Accordingly, a partial reaction may proceed and a film having a small variation in thickness without coating film defects is easily obtained.

Furthermore, in order to improve lubricity between a blade and the protective layer 5; to make the surface of the photoreceptor low in friction and reduce the shaven amount of the photoreceptor to thereby increase the lifetime; and to increase the release property of the toner, the protective layer 5 may contain one or two or more types of fluorine resin particles such as a tetrafluoroethylene resin (PTFE), a trifluoroethylene chloride resin, a hexafluoropropylene resin, a vinyl fluoride resin, a vinylidene fluoride resin, a difluorodichloroethylene resin, and copolymers thereof, and one or two or more types of fatty acid metal salts such as metal stearate e.g., zinc stearate, aluminum stearate, copper stearate, and magnesium stearate, metal oleate e.g., zinc oleate, manganese oleate, iron oleate, copper oleate, and magnesium oleate, metal palmitate e.g., zinc palmitate, copper palmitate, and magnesium palmitate, metal linolate e.g., zinc linolate, and metal ricinolate e.g., zinc ricinolate and lithium ricinolate.

In this case, the protective layer 5 may contain fluorine resin particles and fatty acid metal salt so that a coverage Y (%) of the fatty acid metal salt and a coverage X (%) of the fluorine resin particles on the surface of the protective layer 5 satisfy the relationships represented by the following Expressions (1) and (2).

In addition, the protective layer 5 may contain any one of fluorine resin particles and fatty acid metal salt.

In addition, a dispersion aid for fluorine resin particles may be added to the protective layer 5. The dispersion aid is not particularly limited as long as the dispersibility of the fluorine resin particles is improved, and examples thereof include fluorine surfactants, fluorine polymers, silicone polymers, and silicone oils. As a fluorine-containing graft polymer, for example, resins graft-polymerized with a macromonomer formed of an acrylic acid ester compound, a methacrylic acid ester compound, a styrene compound, and the like and perfluoroalkylethyl methacrylate are preferable. Examples of the commercially available product thereof include GF400 (manufactured by TOAGOSEI Co., Ltd.), Megafac F550 (manufactured by DIC Corporation), and GF300 (manufactured by TOAGOSEI Co., Ltd.).

The coating liquid for film formation is applied to the charge transport layer 3 using a common method such as an inkjet application method, a blade coating method, a wire bar coating method, a spray coating method, a dipping coating method, a bead coating method, an air knife coating method, or a curtain coating method, and if necessary, it is heated for curing at a temperature from 100° C. to 170° C., whereby the protective layer 5 is obtained.

Although surface roughness Rz of the surface of the protective layer 5 is from 0.1 μm to 0.3 μm, it is not particularly limited by a method for adjusting the surface roughness Rz in a specific range.

For example, in the formation of the protective layer 5, when a method such as an inkjet coating method is used in which the surface of a coating film may be adjusted into a predetermined shape, irregularities such as spiral grooves may be formed on the surface of the protective layer 5.

In addition, helix-shaped groove portions may be formed on the surface of the protective layer 5. The method of forming the helix-shaped groove portions is not particularly limited, but a spray coating method is easily used from the viewpoint of productivity such as manufacturing facilities and yield. When helix-shaped groove portions are formed using a spray coating method, these are formed by mainly controlling the rotation rate of a drum and the feed rate of a spray gun at the time of coating. When coating is performed, the rotation rate of the drum is adjusted so that coating unevenness does not occur, and the ejection shape of liquid from the spray gun is adjusted to be elliptical so that the long axis is perpendicular to (oblique to) the sending direction of the gun, whereby helix-shaped groove portions are formed on the surface of the protective layer 5. The helix-shaped groove portions mean rugged streaks (groove portions) that are formed by coating to be helical along the cylindrical shaft of the conductive substrate on the surface of the electrophotographic photoreceptor.

Furthermore, other examples of the method for adjusting the surface roughness Rz in a specific range include mechanical surface abrasion methods.

Although the examples of the functional separation-type photosensitive layer have been described with reference to the electrophotographic photoreceptor 7 shown in FIG. 1, the following forms are preferably employed in the case of the single layer-type photosensitive layer 6 (charge generation/charge transport layer) of the electrophotographic photoreceptor 7 shown in FIG. 3.

That is, the content of a charge generation material in the single layer-type photosensitive layer 6 is from about 10% by weight to about 85% by weight, and preferably from 20% by weight to 50% by weight. In addition, the content of a charge transport material is preferably set to from 3% by weight to 50% by weight. The method of forming the single layer-type photosensitive layer 6 (charge generation/charge transport layer) is the same as the method of forming the charge generation layer 2 and the charge transport layer 3. The thickness of the single layer-type photosensitive layer (charge generation/charge transport layer) 6 is preferably from about 5 μm to about 50 μm, and more preferably from 10 μm to 40 μm.

Image Forming Apparatus, Image Forming Method, and Process Cartridge

In an image forming apparatus of this exemplary embodiment, a coverage Y (%) of fatty acid metal salt and a coverage X (%) of fluorine resin particles on the surface of the surface layer of a photoreceptor are set so as to satisfy the relationships represented by Expressions (1) and (2).

In the image forming apparatus of this exemplary embodiment, it is preferable that the coverage Y (%) and the coverage X (%) further satisfy the relationship represented by Expression (3).

The method of adjusting the surface state of the surface layer of the photoreceptor so as to satisfy the relationships is not particularly limited, and examples thereof include (1) a method in which a supply unit that supplies at least one of fatty acid metal salt and fluorine resin particles to the surface of a surface layer of a photoreceptor is provided in an image forming apparatus so that the coverage Y and the coverage X on the surface of the surface layer of the photoreceptor satisfy the relationships and (2) a method in which at least one of fatty acid metal salt and fluorine resin particles is added to the surface layer of a photoreceptor so that the coverage Y and the coverage X on the surface of the surface layer satisfy the relationships. Furthermore, (3) at least one of fatty acid metal salt and fluorine resin particles may be added to the surface layer of a photoreceptor and a supply unit that supplies at least one of fatty acid metal salt and fluorine resin particles to the surface of the surface layer of the photoreceptor may be provided in an image forming apparatus so that the coverage Y and the coverage X on the surface of the surface layer satisfy the relationships using the sum of at least one of fatty acid metal salt and fluorine resin particles added to the surface layer and at least one of fatty acid metal salt and fluorine resin particles supplied to the surface of the surface layer.

An image forming method of this exemplary embodiment is set so that a coverage Y (%) of fatty acid metal salt and a coverage X (%) of fluorine resin particles on the surface of a surface layer of a photoreceptor satisfy the relationships represented by Expressions (1) and (2). The image forming method of this exemplary embodiment is carried out using the image forming apparatus of this exemplary embodiment.

In the image forming method of this exemplary embodiment, the coverage Y (%) and the coverage X (%) preferably satisfy the relationship represented by Expression (3).

Hereinafter, an image forming apparatus according to a first exemplary embodiment provided with a supply unit will be described with reference to the drawing.

Figure 4:
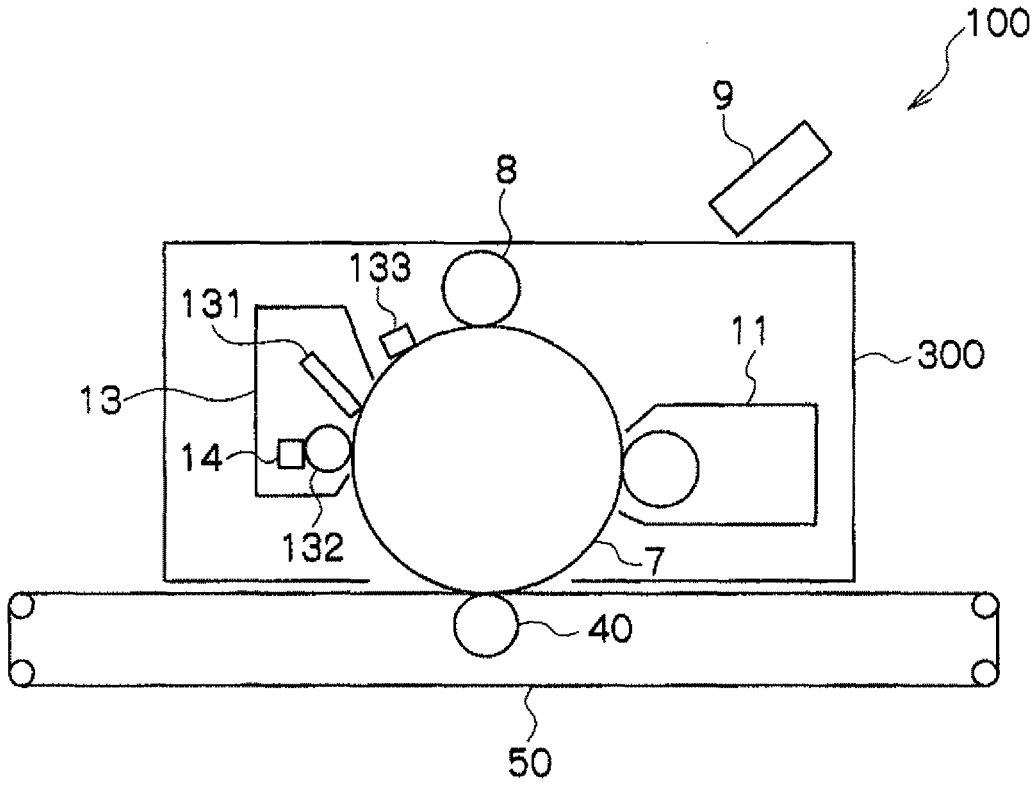
FIG. 4 is a diagram schematically showing the configuration of an image forming apparatus according to a first exemplary embodiment.

FIG. 4 is a diagram schematically showing the configuration of the image forming apparatus according to the first exemplary embodiment. As shown in FIG. 4, the image forming apparatus 100 is provided with a process cartridge 300 provided with an electrophotographic photoreceptor 7, an exposure device 9, a transfer device 40, and an intermediate transfer member 50. In the image forming apparatus 100, the exposure device 9 is disposed so that it is possible to expose the electrophotographic photoreceptor 7 through an opening portion of the process cartridge 300, the transfer device 40 is disposed at a position that is opposed to the electrophotographic photoreceptor 7 with the intermediate transfer member 50 interposed therebetween, and the intermediate transfer member 50 is disposed so as to be partially brought into contact with the electrophotographic photoreceptor 7.

The process cartridge 300 in FIG. 4 integrally supports the electrophotographic photoreceptor 7, a charging device 8, a developing device 11 and a cleaning device 13 in a housing. The cleaning device 13 has a cleaning blade (cleaning member). The cleaning blade 131 is disposed so as to be brought into contact with the surface of the electrophotographic photoreceptor 7. In addition, a fibrous member 133 that assists cleaning of the cleaning blade 131 is disposed so as to be brought into contact with the surface of the electrophotographic photoreceptor 7.

The cleaning device 13 further has a supply brush 132 that is brought into contact with a lubricant supply portion 14 as a supply unit in the downstream of the transfer device 40 and in the upstream of the cleaning blade 131 in the rotation direction of the electrophotographic photoreceptor 7.

The process cartridge of this exemplary embodiment may be provided with the photoreceptor of this exemplary embodiment, and at least one kind selected from the group consisting of a charging unit that charges surface of the electrophotographic photoreceptor, a developing unit that develops an electrostatic latent image formed on the surface of the electrophotographic photoreceptor with a toner to form a toner image, and a cleaning unit that cleans the electrophotographic photoreceptor.

In this exemplary embodiment, the supply unit is not particularly limited as long as a lubricant may be supplied to the surface of the electrophotographic photoreceptor 7. However, a form may be employed in which the supply brush 132 having fibers, which are transplanted to the outer circumference of a shaft and of which the top ends are brought into contact with the surface of the electrophotographic photoreceptor 7, is rotated around the central axis of the shaft to supply a lubricant to the surface of the electrophotographic photoreceptor 7.

In FIG. 4, the supply unit is formed of the supply brush 132 and the lubricant supply portion 14. The supply brush 132 is brought into contact with the lubricant supply portion 14, and a lubricant is held by the supply brush 132. By rotating the supply brush 132 around the central axis, the lubricant is supplied to the surface of the electrophotographic photoreceptor 7 brought into contact with the supply brush 132.

Since the supply brush 132 is brought into contact with the electrophotographic photoreceptor 7, it rotates at the same circumferential speed as the electrophotographic photoreceptor 7 even without having a driving unit, and functions as a supply member. However, the supply brush 132 may have a driving unit attached thereto to be rotated and to supply a lubricant at a circumferential speed different from the electrophotographic photoreceptor. Generally, examples of the material for the shaft constituting the supply brush 132 include iron, copper, brass, stainless steel, aluminum, and nickel. In addition, as for the brush, the thickness of the fibers is 30 d (denier) or less, preferably 20 d, and more preferably from 2 d to 10 d, and the fiber density is 20,000/inch or greater, preferably 30,000/inch or greater, and more preferably 60,000/inch$^2$ or greater.

As the lubricant supply portion 14, a solid lubricant in which a lubricant is molded into a predetermined shape may be used. In this exemplary embodiment, a solid lubricant in which zinc stearate as an example of fatty acid metal salt and PTFE particles as an example of fluorine resin particles are molded into a predetermined shape may be used.

In this exemplary embodiment, as the lubricant for use in the lubricant supply portion 14, the above-described components exemplified as the fluorine resin particles and the fatty acid metal salt that may be added to the protective layer 5 may be used.

The amount of the lubricant supplied to the surface of the electrophotographic photoreceptor 7 is adjusted by changing a pressing force of the lubricant supply portion 14 against the supply brush 132.

In addition, the ratio (weight base) of the fatty acid metal salt to the fluorine resin particles for use in the lubricant supply portion 14 is preferably 50:50 to 90:10, and more preferably 70:30 to 80:20.

By adjusting the amount of the lubricant supplied to the surface of the electrophotographic photoreceptor 7 and adjusting the ratio of the fatty acid metal salt to the fluorine resin particles for use in the lubricant supply portion 14, a coverage Y (%) of the fatty acid metal salt and a coverage X (%) of the fluorine resin particles on the surface of the electrophotographic photoreceptor 7 may be adjusted to satisfy the relationships represented by the following Expressions (1) and (2).

The electrophotographic photoreceptor 7 has a conductive substrate and a photosensitive layer provided on the conductive substrate, and a surface layer positioned on the surface where the photosensitive layer is provided includes a cross-linked component which is a reaction product of compound A and compound B, in which the compound A is at least one compound selected from guanamine compounds and melamine compounds and the compound B is a specific charge-transporting material. A structure derived from at least one compound selected from the guanamine compounds and the melamine compounds included in the surface layer amounts for 0.1% by weight to 5% by weight, a structure derived from the specific charge-transporting material included in the surface layer amounts for 85% by weight or greater, and surface roughness Rz of the surface of the surface layer is from 0.1 μm to 0.3 μm.

The surface layer may include, or may not include at least one of the fatty acid metal salt and the fluorine resin particles.

As the charging device 8, for example, a contact-type charging unit using a conductive or semiconductive charging roller, charging brush, charging film, charging rubber blade, charging tube, or the like is used. In addition, a known charging unit such as a noncontact-type roller charging unit, or a scorotron or corotron charging unit using corona discharge is also used.

Although not shown in the drawing, in order to increase the image stability, a photoreceptor heating member may be provided around the electrophotographic photoreceptor 7 to increase the temperature of the electrophotographic photoreceptor 7 and reduce the relative temperature.

Examples of the exposure device 9 include optical equipment that exposes the surface of the electrophotographic photoreceptor 7 with light such as semiconductor laser light, LED light, or liquid crystal shutter light in the form of an image. The wavelength of a light source is in the spectral sensitivity region of the photoreceptor. As for the wavelength of the semiconductor laser, for example, a near-infrared laser having an oscillation wavelength of approximately 780 nm is predominantly used. However, the wavelength is not limited thereto, and a laser having an oscillation wavelength of 600 nm to less than 700 nm or a laser having an oscillation wavelength of from about 400 nm to about 450 nm may also be used as a blue laser. In addition, it is also effective to use a surface-emitting laser light source that is capable of outputting multi-beams in order to form a color image.

As the developing device 11, for example, a common developing device in which a magnetic or nonmagnetic single- or two-component developer or the like is used in a contact or noncontact manner to perform developing may be used. Such a developing device is not particularly limited as long as it has the above-described functions, and is selected in accordance with the purposes. Examples thereof include known developing devices in which the single- or two-component developer is adhered to the photoreceptor 7 using a brush, a roller, and the like. Among them, a developing roller is preferably used in which a developer is held on the surface.

Hereinafter, a toner for use in the developing device 11 will be described.

The average shape factor ($(ML^2/A)\times(\pi/4)\times100$, where ML represents a maximum length of the particle and A represents a projected area of the particle) of the toner for use in the image forming apparatus of this exemplary embodiment is preferably from 100 to 150, more preferably from 105 to 145, and even more preferably from 110 to 140 from the viewpoint of obtaining high developability, high transferability, and high image quality. Furthermore, a volume average particle diameter of the toner is preferably from 3 μm to 12 μm, more preferably from 3.5 μm to 10 μm, and even more preferably from 4 μm to 9 μm. When the toner satisfying the average shape factor and the volume average particle diameter is used, developability and transferability increase, and an image having high image quality referred to as so-called photography image quality is obtained.

Although the toner is not particularly limited by a manufacturing method as long as the above-described average shape factor and volume average particle diameter are satisfied, a toner is used that is manufactured by, for example, a kneading and pulverizing method in which a binder resin, a colorant, a release agent, and optionally, a charge-controlling agent and the like are added, and the resultant mixture is kneaded, pulverized and classified; a method in which the shapes of the particles obtained using the kneading and pulverizing method are changed by a mechanical impact force or thermal energy; an emulsion polymerization and aggregation method in which polymerizable monomers of a binder resin are subjected to emulsion polymerization, the resultant dispersion formed and a dispersion of a colorant, a release agent, and optionally, a charge-controlling agent and the like are mixed, aggregated, and heat-fused to obtain toner particles; a suspension polymerization method in which polymerizable monomers for obtaining a binder resin, a colorant, a release agent, and optionally, a solution such as a charge-controlling agent are suspended in an aqueous solvent and polymerization is performed; or a dissolution suspension method in which a binder resin, a colorant, a release agent, and optionally, a solution such as a charge-controlling agent are suspended in an aqueous solvent and granulation is performed.

In addition, a known method such as a manufacturing method in which the toner obtained using one of the above methods is used as a core to achieve a core shell structure by further making aggregated particles adhere to the toner and by coalescing them with heating is used. As the toner manufacturing method, a suspension polymerization method, an emulsion polymerization and aggregation method, and a dissolution suspension method, all of which are used to manufacture the toner using an aqueous solvent, are preferable, and an emulsion polymerization and aggregation method is particularly preferable from the viewpoint of controlling the shape and the particle size distribution.

The toner particles preferably contain a binder resin, a colorant, and a release agent, and if necessary, it may further contain silica or a charge-controlling agent.

Examples of the binder resin for use in the toner particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecylmethacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, and polyester resins formed by copolymerization of dicarboxylic acids and diols.

Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Further examples of the binder resin include polyurethane, an epoxy resin, a silicone resin, polyamide, modified rosin, and paraffin wax.

Representative examples of the colorant include magnetic powders such as magnetite and ferrite, carbon black, aniline blue, calcoil blue, chrome yellow, ultramarine blue, Du Pont oil red, quinoline yellow, methylene blue chloride, phthalocyanine blue, malachite green oxalate, lamp black, Rose Bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Representative examples of the release agent include low-molecular-weight polyethylene, low-molecular-weight polypropylene, Fischer-Tropsch wax, montan wax, carnauba wax, rice wax, and candelilla wax.

In addition, as the charge-controlling agent, a known material is used, but an azo metal complex compound, a metal complex compound of salicylic acid, or a polar group-containing resin-type charge-controlling agent is used. When the toner is manufactured by a wet manufacturing method, a material which has poor water solubility is preferably used from the viewpoint of controlling the ionic strength and reducing waste water pollution. In addition, the toner may be either a magnetic toner containing a magnetic material or a nonmagnetic toner containing no magnetic material.

Examples of the transfer device 40 include known transfer charging units such as contact-type transfer charging units using a belt, a roller, a film, a rubber blade, and the like, and scorotron transfer charging units corotron transfer charging units using corona discharge.

As the intermediate transfer member 50, a belt-shaped intermediate transfer member (intermediate transfer belt) of polyimide, polyimide imide, polycarbonate, polyarylate, polyester, rubber, or the like is used. In addition, examples of the shape of the intermediate transfer member 50 include a drum shape other than the belt shape.

In addition to the above-described devices, the image forming apparatus 100 may be further provided with, for example, an optical erasing device that subjects the photoreceptor 7 to optical erasing.

Figure 5:
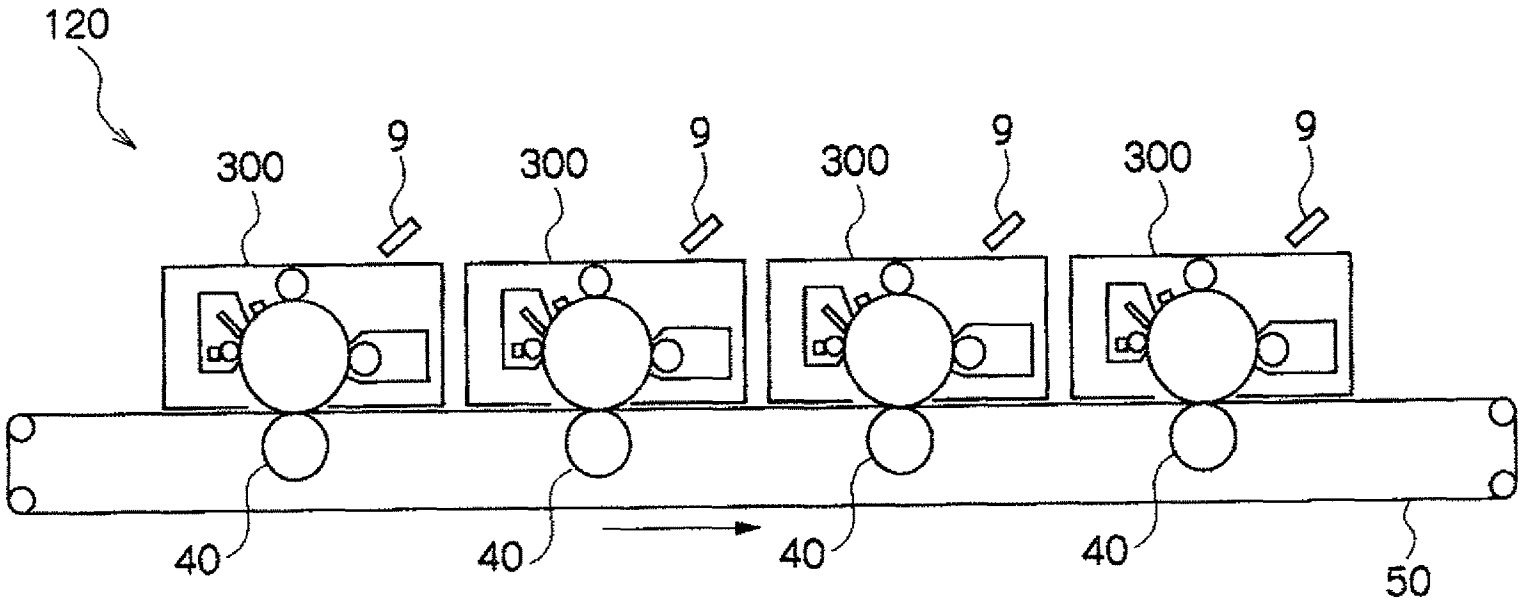
FIG. 5 is a diagram schematically showing the configuration of an image forming apparatus according to a second exemplary embodiment.

FIG. 5 is a cross-sectional view schematically showing an image forming apparatus according to a second exemplary embodiment. As shown in FIG. 5, the image forming apparatus 120 is a tandem-type multicolor image forming apparatus having four process cartridges 300 mounted thereon. In the image forming apparatus 120, the four process cartridges 300 are disposed in parallel to each other on an intermediate transfer member 50, and one electrophotographic photoreceptor is used for one color. The image forming apparatus 120 has the same configuration as that of the image forming apparatus 100, except for being a tandem type.

In the image forming apparatus (process cartridge) according to this exemplary embodiment, the developing device may have a developing roller as a developer holding member that is moved (rotated) in a direction reverse to the moving direction (rotation direction) of the electrophotographic photoreceptor. Here, the developing roller has a cylindrical developing sleeve that holds a developer on the surface thereof, and the developing device may have a regulating member to regulate the amount of the developer to be supplied to the developing sleeve. By moving (rotating) the developing roller of the developing device in a direction reverse to the rotation direction of the electrophotographic photoreceptor, the surface of the electrophotographic photoreceptor is rubbed with the toner remaining between the developing roller and the electrophotographic photoreceptor.

Furthermore, in the image forming apparatus of this exemplary embodiment, the gap between the developing sleeve and the photoreceptor is preferably from 200 μm to 600 μm, and more preferably from 300 μm to 500 μm. Furthermore, the gap between the developing sleeve and a regulating blade as the above-described regulating member that regulates the amount of the developer is preferably from 300 μm to 1,000 μm, and more preferably from 400 μm to 750 μm.

Furthermore, an absolute value of the traveling speed of a developing roll surface is preferably from 1.5 times to 2.5 times, and more preferably from 1.7 times to 2.0 times an absolute value (process speed) of the traveling speed of a photoreceptor surface.

In the image forming apparatus (process cartridge) according to this exemplary embodiment, it is preferable that the developing device (developing unit) be provided with a developer holding member having a magnetic substance, and develop an electrostatic latent image with a two-component developer containing a magnetic carrier and a toner.

Examples of the image forming apparatuses according to other exemplary embodiments include an image forming apparatus having an aspect in which the photoreceptor of this exemplary embodiment in which in the image forming apparatus of FIG. 4, at least one of fluorine resin particles and fatty acid metal salt is incorporated in the surface layer to adjust the coverage X and the coverage Y on the surface of the surface layer to thereby satisfy Expressions (1) and (2) is used as the electrophotographic photoreceptor 7, and no supply unit is provided.

EXAMPLES

Hereinafter, this exemplary embodiment will be described in more detail using the following Examples. However, this exemplary embodiment is not limited thereto.

Example 1

Preparation of Undercoat Layer 100 parts by weight of zinc oxide (average particle diameter: 70 nm: manufactured by Tayca Corporation: specific surface area value: 15 $m^2/g$) is mixed and stirred with 500 parts by weight of tetrahydrofuran, and 1.3 parts by weight of a silane coupling agent (KBM503: manufactured by Shin-Etsu Chemical Co., Ltd.) is added thereto and stirred for 2 hours. Thereafter, the tetrahydrofuran is distilled away by distillation under reduced pressure and baking is performed at 120° C. for 3 hours to obtain zinc oxide surface-treated with the silane coupling agent.

110 parts by weight of the surface-treated zinc oxide and 500 parts by weight of tetrahydrofuran are mixed and stirred, and a solution obtained by dissolving 0.6 part by weight of alizarin in 50 parts by weight of tetrahydrofuran is added thereto and stirred for 5 hours at 50° C. Then, the zinc oxide to which the alizarin has been added is filtrated and separated under reduced pressure, and further is dried at 60° C. under reduced pressure to obtain alizarin-added zinc oxide.

38 parts by weight of a solution obtained by dissolving 60 parts by weight of the alizarin-added zinc oxide, 13.5 parts by weight of a curing agent (blocked isocyanate SUMIDUR 3175, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethylketone. The mixture is dispersed for 2 hours with a sand mill using glass beads having a diameter of 1 mmϕ, and thus a dispersion is obtained.

To the obtained dispersion, 0.005 part by weight of dioctyl tin dilaurate as a catalyst and 40 parts by weight of silicone resin particles (TOSPEARL 145, manufactured by GE Toshiba Silicones Co., Ltd.) are added as catalysts, and thus a coating liquid for undercoat layer formation is obtained. The coating liquid is applied to an aluminum substrate having a diameter of 30 mm, a length of 340 mm and a thickness of 1 mm using a dipping coating method, and is dried for curing at 170° C. for 40 minutes to obtain an undercoat layer having a thickness of 19 μm.

Preparation of Charge Generation Layer

A mixture of 15 parts by weight of hydroxygallium phthalocyanine as a charge generation substance having diffraction peaks at least at Bragg angles (2θ±0.2°) of 7.3°, 16.0°, 24.9° and 28.0° in the X-ray diffraction spectrogram using a CuKα characteristic x-ray, 10 parts by weight of a vinyl chloride-vinyl acetate copolymer resin (VMCH, manufactured by Nippon Unicar Co., Ltd.) as a binder resin, and 200 parts by weight of n-butyl acetate is dispersed with a sand mill using glass beads having a diameter of 1 mmϕ for 4 hours. To the obtained dispersion, 175 parts by weight of n-butyl acetate and 180 parts by weight of methyl ethyl ketone are added and stirred to obtain a coating liquid for charge generating layer formation. The coating liquid for charge generation layer formation is applied to the undercoat layer by dipping coating, and dried at room temperature (25° C.) to form a charge generation layer having a thickness of 0.2 μm.

Preparation of Charge Transport Layer

A coating liquid for charge transport layer formation is obtained by dissolving 45 parts by weight of N,N'-diphenyl-N,N'-bis(3-methylphenyl) [1,1']-biphenyl-4,4'-diamine and 55 parts by weight of a bisphenol-Z polycarbonate resin (viscosity average molecular weight of 50,000) in 800 parts by weight of chlorobenzene. The coating liquid is applied to the charge generation layer, and dried at 130° C. for 45 minutes to form a charge transport layer having a thickness of 20 μm.

Preparation of Protective Layer

A coating liquid for protective layer formation is prepared by adding 2 parts by weight of a guanamine resin (resin) represented by Formula A1, 70 parts by weight of a compound represented by Formula (I-16), 1.0 part by weight of 3,5-di-t-butyl-4-hydroxytoluene (BHT) as an antioxidant, 0.15 part by weight of dodecylbenzenesulfonic acid (manufactured by King Industries, Inc.: Nacure 5225), 50 parts by weight of cyclopentanone, and 35 parts by weigh of cyclopentanol.

Using an inkjet method, the coating liquid for protective layer formation is applied to the charge transport layer in a helical pattern. The coating liquid is air-dried for 30 minutes at room temperature (24° C.), and then cured by heating for 1 hour at 150° C. to form a protective layer (surface layer) having a thickness of 7 μm, whereby a photoreceptor of Example 1 is prepared.

Table 1 shows the total amount of the specific charge-transporting material included in the coating liquid for protective layer formation, and the total amount of the guanamine compound and the melamine compound. Furthermore, table 1 shows the ratio of the structure derived from the specific charge-transporting material included in the surface layer and the ratio of the structure derived from the guanamine compound and the melamine compound, calculated using the total amount of the specific charge-transporting material and the total amount of the guanamine compound and the melamine compound (resin). In addition, Table 1 shows the ratio of the antioxidant included in the surface layer.

In addition, Table 3 shows the measurement result of the ten-point average roughness Rz of the prepared photoreceptor.

Preparation of Lubricant

As a lubricant, a lubricant (lubricant supply portion 14) obtained by mixing zinc stearate (ZnSt) and PTFE (average primary particle diameter of 0.2 μm) at a mixing ratio of 50:10 and by molding the mixture is used. Table 1 shows ratios of the zinc stearate (fatty acid metal salt) and PTFE (fluorine resin particles) in the lubricant and a pressure of the lubricant supply portion against the brush.

Image Quality Evaluation

The electrophotographic photoreceptors and lubricants prepared as described above are mounted on DocuCentre Color 400CP (manufactured by Fuji Xerox Co., Ltd.) to perform the following evaluations.

That is, the above-described image forming apparatus is left for 24 hours under the environment of room temperature of 10° C. and humidity of 15%. Then, a 50%-half-tone image is output, and at that time, a coverage (%) of the zinc stearate and a coverage (%) of the PTFE on the surface of the photoreceptor are measured by XPS.

Next, the image forming apparatus is left for 24 hours under the environment of room temperature of 30° C. and humidity of 85%. A letter image is output on J-paper (A4 size) (manufactured by Fuji Xerox Co., Ltd.) until the number of rotations of the photoreceptor is 1,000, and a letter image output at the first rotation and a letter image output at the 1,000-th rotation are evaluated. In addition, at that time, a coverage (%) of the zinc stearate and a coverage (%) of the PTFE on the surface of the photoreceptor are measured by XPS.

Regarding the image quality of the output half-tone image, the letter image is evaluated by sharpness of the letter on the basis of the following standards from the viewpoint of whether or not there are streaky image defects caused by slipping-through.

The streaky image quality defects are evaluated on a scale of 1 to 5. When the result is 2 or less, a problem may occur in practical use.

5: Very Good (No streaks)

4: Good (Streaks are almost not shown)

3: Normal (Streaks may be confirmed, but there are no problems)

2: Bad (Streaks may be confirmed and there is a problem)

1: Very bad (Streaks may be clearly confirmed and there is a problem)

The letter image is evaluated from the viewpoint of whether or not there is a disturbance of letter. When the result is 2 or less, a problem may occur in practical use.

5: Very Good (No disturbance)

4: Good (Disturbance is almost not shown)

3: Normal (Although fine lines of the letter are missed, there are no problems)

2: Bad (fine lines of the letter are missed and there is a problem)

1: Very bad (fine lines of the letter are missed and there is a problem)

Furthermore, a 50%-half-tone image is continuously output at room temperature of 10° C. with a humidity of 15% until the photoreceptor rotates 1,000,000 times. Thereafter, a film reduction amount of the photoreceptor is evaluated and set as an indicator of long lifetime. The film reduction amount of the photoreceptor is measured using a Permascope (manufactured by Fischer Instruments K.K.).

Table 3 shows the evaluation results of the evaluation.

Examples 2 to 23 and Comparative Examples 1 to 12

A photoreceptor is prepared in the same manner as in Example 1, except that in Example 1, the type and the content of the resin (guanamine compound or melamine compound), the type and the content of the specific charge-transporting material, and the ratio of the antioxidant, all of which are contained in the coating liquid for protective layer formation, the type of the fatty acid metal salt, the type of the fluorine resin particles, the ratio (weight ratio) of the fatty acid metal salt to the fluorine resin particles in the lubricant, and the pressure of the lubricant supply portion against the brush are adjusted to the values described in Table 1 or 2, and the evaluation is performed. The obtained results are shown in Table 3 or 4.

In Table 1, FEP represents a tetrafluoroethylene-hexafluoropropylene copolymer, and PFA represents a tetrafluoroethylene-perfluoroalkyl vinyl ether.

Example 24

The parts by weight of polytetrafluoroethylene described in Table 5 (average primary particle diameter of 0.2 μm) and 3% by weight of a fluorine comb-type graft polymer as a dispersion aid (manufactured by TOAGOSEI Co., Ltd., trade name: GF400) with respect to the polytetrafluoroethylene are held at a liquid temperature of 20° C. together with 20 parts by weight of cyclopentanone and 15 parts by weight of cyclopentanol, and mixed and stirred for 24 hours. The mixture is repeatedly subjected to a dispersion treatment 6 times under pressure increased to 500 kgf/cm$^2$ using a high-pressure homogenizer (manufactured by Yoshida Kikai Co., Ltd.) having a penetration-type chamber mounted thereon with a fine channel to obtain a coating liquid for protective layer formation (2).

Meanwhile, a coating liquid for protective layer formation (1) is prepared by adding the resin of a kind and an amount described in Table 5, the specific charge-transporting material, 1.0 part by weight of 3,5-di-t-butyl-4-hydroxytoluene (BHT) as an antioxidant, 0.15 part by weight of dodecylbenzenesulfonic acid (manufactured by King Industries, Inc.: Nacure 5225), 50 parts by weight of cyclopentanone, and 35 parts by weight of cyclopentanol.

The coating liquid for protective layer formation (1) and the coating liquid for protective layer formation (2) are mixed to obtain a coating liquid for protective layer formation. A photoreceptor is prepared in the same manner as in Example 1, except that the obtained coating liquid for protective layer formation is used.

Next, 50 parts by weight of zinc stearate (ZnSt), 10 parts by weight of PTFE (average primary particle diameter of 0.2 μm), and 40 parts by weight of aluminum stearate (AlSt) are mixed and then molded to obtain a lubricant (lubricant supply portion 14).

The evaluation is performed in the same manner as in Example 1, except that the obtained photoreceptor and lubricant are used. The obtained results are shown in Table 6.

Example 25 to 31 and Comparative Examples 13 and 14

In Example 24, a photoreceptor is prepared in the same manner as in Example 1, except that the types and contents of components contained in the coating liquid for protective layer formation (1) and the coating liquid for protective layer formation (2), the ratio of the fatty acid metal salt and the fluorine resin particles in the lubricant, and the pressure of the lubricant supply portion against the brush are changed to the values described in Table 5, and the evaluation is performed. The obtained results are shown in Table 6.

TABLE 1

| | Coating Liquid for Protective Layer Formation | | | | Protective Layer | | | Lubricant | | |
|---|---|---|---|---|---|---|---|---|---|---|
| | Specific Charge Transport Material | Parts by Weight | Resin | Parts by Weight | Structure Derived from Specific Charge Transport Material % by Weight | Structure Derived from Resin % by Weight | Anti-oxidant % by Weight | Type of Fatty Acid Metal Salt Weight Ratio | Type of Fluorine Resin Particles Weight Ratio | Pressure of Lubricant Supply Portion Against Brush |
| Example 1 | I-16 | 70 | A1 | 2 | 96 | 3 | 1 | ZnSt 50 | PTFE 10 | 100 g wt. |
| Example 2 | I-16 | 70 | A1 | 2 | 96 | 3 | 1 | ZnSt 100 | 0 | 40 g wt. |
| Example 3 | I-16 | 70 | A1 | 2 | 96 | 3 | 1 | ZnSt 100 | 0 | 100 g wt. |
| Example 4 | I-16 | 70 | A1 | 2 | 96 | 3 | 1 | ZnSt 100 | PTFE 10 | 100 g wt. |
| Example 5 | I-16 | 70 | A1 | 2 | 96 | 3 | 1 | ZnSt 25 | PTFE 25 | 100 g wt. |
| Example 6 | I-16 | 70 | A1 | 2 | 96 | 3 | 1 | ZnSt 20 | PTFE 15 | 100 g wt. |
| Example 7 | I-16 | 72 | A1 | 1 | 98 | 1 | 1 | ZnSt 50 | PTFE 10 | 100 g wt. |
| Example 8 | I-16 | 62 | A1 | 3 | 85 | 5 | 10 | ZnSt 50 | PTFE 10 | 100 g wt. |
| Example 9 | I-16 | 70 | A1 | 0.1 | 96 | 0.1 | 4 | ZnSt 50 | PTFE 10 | 100 g wt. |
| Example 10 | I-1 | 70 | A1 | 2 | 96 | 3 | 1 | ZnSt 50 | PTFE 10 | 100 g wt. |
| Example 11 | I-7 | 70 | A1 | 2 | 96 | 3 | 1 | ZnSt 50 | PTFE 10 | 100 g wt. |
| Example 12 | I-22 | 70 | A1 | 2 | 96 | 3 | 1 | ZnSt 50 | PTFE 10 | 100 g wt. |
| Example 13 | I-33 | 70 | A1 | 2 | 96 | 3 | 1 | ZnSt 50 | PTFE 10 | 100 g wt. |
| Example 14 | I-16 | 70 | A8 | 2 | 96 | 3 | 1 | ZnSt 50 | PTFE 10 | 100 g wt. |
| Example 15 | I-16 | 70 | A14 | 2 | 96 | 3 | 1 | ZnSt 50 | PTFE 10 | 100 g wt. |
| Example 16 | I-16 | 70 | A20 | 2 | 96 | 3 | 1 | ZnSt 50 | PTFE 10 | 100 g wt. |
| Example 17 | I-16 | 70 | B1 | 2 | 96 | 3 | 1 | ZnSt 50 | PTFE 10 | 100 g wt. |
| Example 18 | I-16 | 70 | B7 | 2 | 96 | 3 | 1 | ZnSt 50 | PTFE 10 | 100 g wt. |
| Example 19 | I-16 | 70 | A1 | 2 | 96 | 3 | 1 | Zinc Oleate 50 | PTFE 10 | 100 g wt. |
| Example 20 | I-16 | 70 | A1 | 2 | 96 | 3 | 1 | AlSt 50 | PTFE 10 | 100 g wt. |
| Example 21 | I-16 | 70 | A1 | 2 | 96 | 3 | 1 | Zinc Palmitate 50 | PTFE 10 | 100 g wt. |
| Example 22 | I-16 | 70 | A1 | 2 | 96 | 3 | 1 | ZnSt 50 | FEP 10 | 100 g wt. |
| Example 23 | I-16 | 70 | A1 | 2 | 96 | 3 | 1 | ZnSt 50 | PFA 10 | 100 g wt. |

TABLE 2

| | Coating Liquid for Protective Layer Formation | | | | Protective Layer | | | Lubricant | | |
|---|---|---|---|---|---|---|---|---|---|---|
| | Specific Charge Transport Material | Parts by Weight | Resin | Parts by Weight | Structure Derived from Specific Charge Transport Material % by Weight | Structure Derived from Resin % by Weight | Anti-oxidant % by Weight | Type of Fatty Acid Metal Salt Weight Ratio | Type of Fluorine Resin Particles Weight Ratio | Pressure of Lubricant Supply Portion Against Brush |
| Comparative Example 1 | I-16 | 70 | A1 | 2 | 96 | 3 | 1 | 0 | 0 | — |
| Comparative Example 2 | I-16 | 70 | A1 | 2 | 96 | 3 | 1 | 0 | PTFE 20 | 100 g wt. |
| Comparative Example 3 | I-16 | 70 | A1 | 2 | 96 | 3 | 1 | ZnSt 10 | PTFE 20 | 100 g wt. |
| Comparative Example 4 | I-16 | 70 | A1 | 2 | 96 | 3 | 1 | ZnSt 60 | PTFE 25 | 100 g wt. |
| Comparative Example 5 | I-16 | 70 | A1 | 2 | 96 | 3 | 1 | ZnSt 100 | PTFE 20 | 100 g wt. |
| Comparative Example 6 | I-16 | 70 | A1 | 2 | 83 | 3 | 14 | ZnSt 50 | PTFE 10 | 100 g wt. |
| Comparative Example 7 | I-16 | 70 | A1 | 0.07 | 96 | 0.09 | 4 | ZnSt 50 | PTFE 10 | 100 g wt. |
| Comparative Example 8 | I-16 | 68 | A1 | 2 | 93 | 6 | 1 | ZnSt 50 | PTFE 10 | 100 g wt. |
| Comparative Example 9 | I-16 | 70 | A1 | 2 | 96 | 3 | 1 | ZnSt 100 | 0 | 75 g wt. |
| Comparative Example 10 | I-16 | 70 | A1 | 2 | 96 | 3 | 1 | ZnSt 35 | PTFE 30 | 100 g wt. |
| Comparative Example 11 | I-16 | 70 | A1 | 2 | 96 | 3 | 1 | ZnSt 100 | 0 | 20 g wt. |
| Comparative Example 12 | I-16 | 70 | A1 | 2 | 96 | 3 | 1 | ZnSt 10 | PTFE 30 | 100 g wt. |

TABLE 3

| | | 10° C., 15% | | | | 30° C., 85% | | | | | |
|---|---|---|---|---|---|---|---|---|---|---|---|
| | | XPS Evaluation | | | Image | XPS Evaluation | | | Image Quality Evaluation Letter Fine Line | | |
| | Rz μm | Coverage Y % | Coverage X % | Within/ Outside Specified Range | Quality Evaluation Half-Tone | Coverage Y % | Coverage X % | Within/ Outside Specified Range | First Piece of Paper | After 1,000 Rotations of Photo-receptor | Film Reduc-tion Amount μm |
| Example 1 | 0.2 | 50 | 10 | Within the range | 5 | 50 | 10 | Within the range | 5 | 5 | 2.5 |
| Example 2 | 0.2 | 40 | 0 | Within the range | 4 | 40 | 0 | Within the range | 4 | 4 | 2.4 |
| Example 3 | 0.2 | 100 | 0 | Within the range | 4 | 100 | 0 | Within the range | 4 | 4 | 2.5 |
| Example 4 | 0.2 | 100 | 10 | Within the range | 4 | 100 | 10 | Within the range | 4 | 4 | 2.5 |
| Example 5 | 0.2 | 25 | 25 | Within the range | 4 | 25 | 25 | Within the range | 4 | 4 | 2.4 |
| Example 6 | 0.2 | 20 | 15 | Within the range | 4 | 20 | 15 | Within the range | 4 | 4 | 2.5 |
| Example 7 | 0.2 | 50 | 10 | Within the range | 5 | 50 | 10 | Within the range | 5 | 5 | 2.5 |
| Example 8 | 0.2 | 50 | 10 | Within the range | 5 | 50 | 10 | Within the range | 5 | 5 | 2.7 |
| Example 9 | 0.2 | 50 | 10 | Within the range | 5 | 50 | 10 | Within the range | 5 | 5 | 2.4 |
| Example 10 | 0.2 | 50 | 10 | Within the range | 5 | 50 | 10 | Within the range | 5 | 5 | 2.5 |
| Example 11 | 0.2 | 50 | 10 | Within the range | 5 | 50 | 10 | Within the range | 5 | 5 | 2.4 |
| Example 12 | 0.2 | 50 | 10 | Within the range | 5 | 50 | 10 | Within the range | 5 | 5 | 2.5 |
| Example 13 | 0.2 | 50 | 10 | Within the range | 5 | 50 | 10 | Within the range | 5 | 5 | 2.5 |
| Example 14 | 0.2 | 50 | 10 | Within the range | 5 | 50 | 10 | Within the range | 5 | 5 | 2.4 |
| Example 15 | 0.2 | 50 | 10 | Within the range | 5 | 50 | 10 | Within the range | 5 | 5 | 2.5 |
| Example 16 | 0.2 | 50 | 10 | Within the range | 5 | 50 | 10 | Within the range | 5 | 5 | 2.5 |
| Example 17 | 0.2 | 50 | 10 | Within the range | 5 | 50 | 10 | Within the range | 5 | 5 | 2.4 |
| Example 18 | 0.2 | 50 | 10 | Within the range | 5 | 50 | 10 | Within the range | 5 | 5 | 2.5 |
| Example 19 | 0.2 | 50 | 10 | Within the range | 5 | 50 | 10 | Within the range | 5 | 5 | 2.5 |
| Example 20 | 0.2 | 50 | 10 | Within the range | 5 | 50 | 10 | Within the range | 5 | 5 | 2.5 |
| Example 21 | 0.2 | 50 | 10 | Within the range | 5 | 50 | 10 | Within the range | 5 | 5 | 2.5 |
| Example 22 | 0.2 | 50 | 10 | Within the range | 5 | 50 | 10 | Within the range | 5 | 5 | 2.5 |
| Example 23 | 0.2 | 50 | 10 | Within the range | 5 | 50 | 10 | Within the range | 5 | 5 | 2.5 |

TABLE 4

| | | 10° C., 15% | | | | 30° C., 85% | | | | | |
|---|---|---|---|---|---|---|---|---|---|---|---|
| | | XPS Evaluation | | | Image | XPS Evaluation | | | Image Quality Evaluation Letter Fine Line | | Film |
| | Rz μm | Coverage Y % | Coverage X % | Within/ Outside Specified Range | Quality Evaluation Half-Tone | Coverage Y % | Coverage X % | Within/ Outside Specified Range | First Piece of Paper | After 1,000 Rotations of Photo-receptor | Reduc-tion Amount μm |
| Comparative Example 1 | 0.2 | 0 | 0 | Outside the range | 1 | 0 | 0 | Outside the range | 1 | 1 | 2.5 |
| Comparative Example 2 | 0.2 | 0 | 20 | Outside the range | 4 | 0 | 20 | Outside the range | 2 | 4 | 2.5 |
| Comparative Example 3 | 0.2 | 10 | 20 | Outside the range | 4 | 10 | 20 | Outside the range | 2 | 4 | 2.5 |
| Comparative Example 4 | 0.2 | 60 | 25 | Outside the range | 1 | 60 | 25 | Outside the range | 4 | 4 | 2.4 |
| Comparative Example 5 | 0.2 | 100 | 20 | Outside the range | 1 | 100 | 20 | Outside the range | 4 | 4 | 2.5 |
| Comparative Example 6 | 0.2 | 50 | 10 | Within the range | 4 | 50 | 10 | Within the range | 4 | 4 | 3.1 |
| Comparative Example 7 | 0.2 | 50 | 10 | Within the range | 4 | 50 | 10 | Within the range | 4 | 4 | 3.2 |
| Comparative Example 8 | 0.2 | 50 | 10 | Within the range | 4 | 50 | 10 | Within the range | 4 | 3 | 2.3 |
| Comparative Example 9 | 0.2 | 75 | 0 | Outside the range | 1 | 75 | 0 | Outside the range | 1 | 1 | 2.0 |
| Comparative Example 10 | 0.2 | 35 | 30 | Outside the range | 1 | 35 | 30 | Outside the range | 2 | 2 | 2.5 |
| Comparative Example 11 | 0.2 | 20 | 0 | Outside the range | 2 | 20 | 0 | Outside the range | 2 | 2 | 2.4 |
| Comparative Example 12 | 0.2 | 10 | 30 | Outside the range | 2 | 10 | 30 | Outside the range | 2 | 2 | 2.4 |

TABLE 5

| | Coating Liquid for Protective Layer Formation (1) | | | | Coating Liquid for Protective Layer Formation (2) | | Protective Layer Structure | | | Lubricant | | Pressure |
|---|---|---|---|---|---|---|---|---|---|---|---|---|
| | Specific Charge Transport Material | Parts by Weight | Resin | Parts by Weight | Type of Flourine Resin Particles Parts by Weight | Disper-sion Aid Parts by Weight | Derived from Specific Charge Transport Material % by Weight | Structure Derived from Resin % by Weight | Anti-oxidant % by Weight | Type of Fatty Acid Metal Salt Weight Ratio | Type of Fluorine Resin Particles Weight Ratio | of Lubricant Supply Portion Against Brush |
| Example 24 | I-16 | 70 | A1 | 2 | PTFE 6 | 0.18 | 96 | 3 | 1 | ZnSt 50 AlSt 40 | PTFE 10 | 100 g wt. |
| Example 25 | I-16 | 70 | A1 | 2 | PTFE 6 | 0.18 | 96 | 3 | 1 | ZnSt 100 | 0 | 40 g wt. |
| Example 26 | I-16 | 70 | A1 | 2 | PTFE 6 | 0.18 | 96 | 3 | 1 | ZnSt 100 | 0 | 100 g wt. |
| Example 27 | I-16 | 70 | A1 | 2 | PTFE 6 | 0.18 | 96 | 3 | 1 | ZnSt 100 | PTFE 10 | 100 g wt. |
| Example 28 | I-16 | 70 | A1 | 2 | PTFE 6 | 0.18 | 96 | 3 | 1 | ZnSt 25 | PTFE 25 | 100 g wt. |
| Example 29 | I-16 | 70 | A1 | 2 | PTFE 6 | 0.18 | 96 | 3 | 1 | ZnSt 20 | PTFE 15 | 100 g wt. |
| Example 30 | I-16 | 70 | A1 | 2 | PTFE 10 | 0.3 | 96 | 3 | 1 | ZnSt 50 | PTFE 10 | 100 g wt. |
| Example 31 | I-16 | 70 | A1 | 2 | PTFE 15 | 0.45 | 96 | 3 | 1 | ZnSt 50 | PTFE 10 | 100 g wt. |
| Comparative Example 13 | I-16 | 70 | A1 | 2 | 0 | 0.18 | 96 | 3 | 1 | ZnSt 50 | PTFE 10 | 100 g wt. |
| Comparative Example 14 | I-16 | 70 | A1 | 2 | PFTE 6 | 0.12 | 96 | 3 | 1 | ZnSt 50 | PTFE 10 | 100 g wt. |

TABLE 6

| | | 10° C., 15% | | | | 30° C., 85% | | | | | |
|---|---|---|---|---|---|---|---|---|---|---|---|
| | | XPS Evaluation | | | Image | XPS Evaluation | | | Image Quality Evaluation Letter Fine Line | | |
| | Rz μm | Coverage Y % | Coverage X % | Within/ Outside Specified Range | Quality Evaluation Half-Tone | Coverage Y % | Coverage X % | Within/ Outside Specified Range | First Piece of Paper | After 1,000 Rotations of Photo-receptor | Film Reduc-tion Amount μm |
| Example 24 | 0.2 | 50 | 10 | Within the range | 4 | 50 | 10 | Within the range | 4 | 4 | 1.5 |
| Example 25 | 0.2 | 30 | 0 | Within the range | 4 | 30 | 0 | Within the range | 4 | 4 | 1.5 |
| Example 26 | 0.2 | 100 | 0 | Within the range | 4 | 100 | 0 | Within the range | 4 | 4 | 1.4 |
| Example 27 | 0.2 | 100 | 10 | Within the range | 4 | 100 | 10 | Within the range | 4 | 4 | 1.5 |
| Example 28 | 0.2 | 25 | 25 | Within the range | 4 | 25 | 25 | Within the range | 4 | 4 | 1.5 |
| Example 29 | 0.2 | 20 | 15 | Within the range | 4 | 20 | 15 | Within the range | 4 | 4 | 1.5 |
| Example 30 | 0.2 | 50 | 10 | Within the range | 4 | 50 | 10 | Within the range | 4 | 4 | 1 |
| Example 31 | 0.2 | 50 | 10 | Within the range | 4 | 50 | 10 | Within the range | 4 | 4 | 0.8 |
| Comparative Example 13 | 0.09 | 50 | 10 | Within the range | 2 | 50 | 10 | Within the range | 2 | 2 | 2.5 |
| Comparative Example 14 | 0.32 | 50 | 10 | Within the range | 1 | 50 | 10 | Within the range | 1 | 1 | 2.4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a photosensitive layer; and a surface layer that is provided on the photosensitive layer or is contained in the photosensitive layer;

wherein, the surface layer includes a cross-linked component which is a reaction product of compound A and compound B, wherein the compound A is at least one compound selected from guanamine compounds and melamine compounds, and the compound B is a charge-transporting material having at least one substituent selected from —OH, —$OCH_3$, —$NH_2$, —SB, and —COOH, a structure derived from at least one compound selected from the guanamine compounds and the melamine compounds included in the surface layer amounts for 0.1% by weight to 5% by weight, and a structure derived from the charge-transporting material included in the surface layer amounts for 85% by weight or greater, surface roughness Rz of the surface layer is from 0.1 μm to 0.3 μm, and the surface has at least one compound selected from fatty acid metal salt and fluorine resin particles, and the electrophotographic photoreceptor satisfies the relationships represented by the following Expressions (1) and (2):

$$Y \leq -5X+150 \quad \text{Expression (1)}$$

$$Y \geq -0.75X+30 \quad \text{Expression (2)}$$

wherein Y represents a coverage of the fatty acid metal salt, and X represents a coverage of the fluorine resin particles.

2. The electrophotographic photoreceptor according to claim 1, wherein the electrophotographic photoreceptor further satisfies the relationship represented by the following Expression (3):

$$Y > 5X-100 \quad \text{Expression (3).}$$

3. The electrophotographic photoreceptor according to claim 2, wherein the surface roughness Rz of the surface layer is from 0.1 μm to 0.15 μm.

4. The electrophotographic photoreceptor according to claim 1, wherein the surface roughness Rz of the surface layer is from 0.1 μm to 0.15 μm.

5. The electrophotographic photoreceptor according to claim 1, wherein the fatty acid metal salt is a compound selected from metal stearate, metal oleate, metal palmitate, metal linoleate, and metal ricinoleate.

6. A process cartridge comprising:

an electrophotographic photoreceptor; and at least one unit selected from (A) a charging unit that charges a surface of the electrophotographic photoreceptor, (B) a developing unit that develops an electrostatic latent image formed on the surface of the electrophotographic photoreceptor with a toner to form a toner image, and (C) a cleaning unit that cleans the electrophotographic photoreceptor, wherein the electrophotographic photoreceptor is the electrophotographic photoreceptor according to claim 1.

7. The process cartridge according to claim 6, wherein the electrophotographic photoreceptor satisfies the relationship represented by the following Expression (3):

$$Y>5X-100 \quad \text{Expression (3).}$$

8. The process cartridge according to claim 6, wherein in the electrophotographic photoreceptor, the surface roughness Rz of the surface layer is from 0.1 to 0.15 μm.

9. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor with a toner to form a toner image; and a transfer unit that transfers the toner image formed on the surface of the electrophotographic photoreceptor onto a recording medium, wherein the electrophotographic photoreceptor is the electrophotographic photoreceptor according to claim 1.

10. The image forming apparatus according to claim 9, wherein the electrophotographic photoreceptor satisfies the relationship represented by the following Expression (3):

$$Y>5X-100 \quad \text{Expression (3)}$$

11. The image forming apparatus according to claim 9, wherein in the electrophotographic photoreceptor, the surface roughness Rz of the surface layer is from 0.1 μm to 0.15 μm.

12. An image forming apparatus comprising:

an electrophotographic photoreceptor including a conductive substrate, a photosensitive layer, and a surface layer that is provided on the photosensitive layer or is contained in the photosensitive layer, wherein, the surface layer includes a cross-linked component which is a reaction product of compound A and compound B, wherein the compound A is at least one compound selected from guanamine compounds and melamine compounds, and the compound B is a charge-transporting material having at least one substituent selected from —OH, —$OCH_3$, —$NH_2$, —SH, and —COOH, a structure derived from at least one compound selected from the guanamine compounds and the melamine compounds included in the surface layer amounts for 0.1% by weight to 5% by weight, a structure derived from the charge-transporting material included in the surface layer amounts for 85% by weight or greater, and a surface of the surface layer has surface roughness Rz of from 0.1 μm to 0.3 μm;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with an electrostatic latent image developer to form a toner image;

a transfer unit that transfers the toner image formed on the surface of the electrophotographic photoreceptor onto a transfer member; and a supply unit that supplies a compound selected from at least one of fatty acid metal salt and fluorine resin particles to the surface of the electrophotographic photoreceptor after transfer of the toner image onto the transfer member, wherein in the supply unit, the surface of the electrophotographic photoreceptor satisfies the relationships represented by the following Expressions (1) and (2):

$$Y\leq-5X+150 \quad \text{Expression (1)}$$

$$Y\geq-0.75X+30 \quad \text{Expression (2)}$$

wherein Y represents a coverage of the fatty acid metal salt, and X represents a coverage of the fluorine resin particles.

13. The image forming apparatus according to claim 12, wherein in the supply unit, the surface of the electrophotographic photoreceptor satisfies the relationship represented by the following Expression (3):

$$Y>5X-100 \quad \text{Expression (3).}$$

14. The image forming apparatus according to claim 12, wherein in the electrophotographic photoreceptor, the surface roughness Rz of the surface layer is from 0.1 μm to 0.15 μm.

15. An image forming method comprising:

charging a surface of an electrophotographic photoreceptor including a conductive substrate, photosensitive layer, and a surface layer that is provided on the photosensitive layer or is contained in the photosensitive layer, wherein, the surface layer includes a cross-linked component which is a reaction product of compound A and compound B, wherein the compound A is at least one compound selected from guanamine compounds and melamine compounds, and the compound B is a charge-transporting material having at least one substituent selected from —OH, —OCH, —$NH_2$, —SH, and —COOH, a structure derived from at least one compound selected from the guanamine compounds and the melamine compounds included in the surface layer amounts for 0.1% by weight to 5% by weight, a structure derived from the charge-transporting material included in the surface layer amounts for 85% by weight or greater, and a surface of the surface layer has surface roughness Rz of from 0.1 μm to 0.3 μm;

forming an electrostatic latent image on a charged surface of the electrophotographic photoreceptor;

developing the electrostatic latent image formed on the surface of the electrophotographic photoreceptor with an electrostatic latent image developer to form a toner image;

transferring the toner image formed on the surface of the electrophotographic photoreceptor onto a transfer member; and supplying a compound selected from at least one of fatty acid metal salt and fluorine resin particles to the surface of the electrophotographic photoreceptor after the transferring, wherein the supplying is carried out so that the surface of the electrophotographic photoreceptor satisfies the relationships represented by the following Expressions (1) and (2):

$$Y \leq -5X+150 \quad \text{Expression (1)}$$

$$Y \geq -0.75X+30 \quad \text{Expression (2)}$$

wherein Y represents a coverage of the fatty acid metal salt, and X represents a coverage of the fluorine resin particles.

16. The image forming method according to claim 15, wherein the supplying is carried out so that the surface of the electrophotographic photoreceptor satisfies the relationship represented by the following Expression (3):

$$Y > 5X-100 \quad \text{Expression (3).}$$

17. The image forming method according to claim 15, wherein in the electrophotographic photoreceptor, the surface roughness Rz of the surface layer is from 0.1 μm to 0.15 μm.

* * * * *